US012571394B2

(12) United States Patent
Kawabata et al.

(10) Patent No.: US 12,571,394 B2
(45) Date of Patent: Mar. 10, 2026

(54) SCROLL COMPRESSOR WITH BLOCKING PART FOR OIL SEPARATION

(71) Applicant: DAIKIN INDUSTRIES, LTD., Osaka (JP)

(72) Inventors: Shinichi Kawabata, Osaka (JP); Toshiyuki Toyama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/643,581

(22) Filed: Apr. 23, 2024

(65) Prior Publication Data

US 2024/0271623 A1 Aug. 15, 2024

Related U.S. Application Data

(63) Continuation of application No. PCT/JP2022/035664, filed on Sep. 26, 2022.

(30) Foreign Application Priority Data

Nov. 1, 2021 (JP) ..... 2021-178785

(51) Int. Cl.
*F04C 29/02* (2006.01)
*F04C 18/02* (2006.01)
*F04C 29/12* (2006.01)

(52) U.S. Cl.
CPC ..... *F04C 29/026* (2013.01); *F04C 18/0215* (2013.01); *F04C 29/02* (2013.01); (Continued)

(58) Field of Classification Search
CPC .... F04C 29/026; F04C 18/0215; F04C 29/02; F04C 29/028; F04C 29/12; F04C 2240/30
See application file for complete search history.

(56) References Cited

U.S. PATENT DOCUMENTS 9,410,547 B2 * 8/2016 Toyama ..... F04C 29/026
2020/0149547 A1 * 5/2020 Kim ..... F04C 29/026
(Continued)

FOREIGN PATENT DOCUMENTS

CN 101936292 A 1/2011
JP 62-38884 A 2/1987
(Continued)

OTHER PUBLICATIONS

Foreign Patent Publication and Machine Translation for JP 2012-97575; 1st Inventor: Fukunaga; Title: Scroll Type Compressor; Published: May 24, 2012. (Year: 2012).*
(Continued)

*Primary Examiner* — Mary A Davis
(74) *Attorney, Agent, or Firm* — Spencer Fane LLP

(57) ABSTRACT

A compressor includes a casing, an electric motor housed in the casing, and a compression mechanism driven by the electric motor. The compression mechanism discharges a gas compressed to an internal space of the casing. The gas discharged from the compression mechanism forms a gas flow that flows in a predetermined direction in the internal space of the casing. A component having a facing surface that faces against the gas flow is arranged in the internal space of the casing. The component is provided with a blocking part configured to block a flow of oil deposited on the facing surface due to a collision of the gas flow.

20 Claims, 14 Drawing Sheets

(52) U.S. Cl.
CPC ..... *F04C 29/028* (2013.01); *F04C 29/12* (2013.01); *F04C 2240/30* (2013.01); *F04C 2240/40* (2013.01)

(56) References Cited

U.S. PATENT DOCUMENTS

| | | | | |
|---|---|---|---|---|
| 2020/0191145 | A1* | 6/2020 | Iwatake ..... | F04C 29/026 |
| 2021/0262467 | A1 | 8/2021 | Park et al. | |
| 2022/0316479 | A1 | 10/2022 | Araki et al. | |

FOREIGN PATENT DOCUMENTS

| | | | |
|---|---|---|---|
| JP | 2012-202208 | A | 10/2012 |
| JP | 2013-24129 | A | 2/2013 |
| JP | 2013-60937 | A | 4/2013 |
| JP | 2015-55191 | A | 3/2015 |
| JP | 2015-55192 | A | 3/2015 |
| JP | 2015-105637 | A | 6/2015 |
| JP | 2018-40372 | A | 3/2018 |
| WO | 2019/102673 | A1 | 5/2019 |
| WO | 2021/153541 | A1 | 8/2021 |

OTHER PUBLICATIONS

Foreign Patent Publication and Machine Translation for KR 2009-0100307 A; 1st Inventor: Sakamoto; Title: Scroll Compressor; Published: Sep. 23, 2009. (Year: 2009).*

WIPO Publication and Machine Translation for WO 2018/130134 A1; 1st Inventor: Zhao; Title: Compressor; Published: Jul. 19, 2018. (Year: 2018).*

WIPO Publication and Machine Translation for WO 2021/005918 A1; 1st Inventor: Toyama; Title: Compressor, And Refrigeration Device; Published: Jan. 14, 2021. (Year: 2021).*

International Search Report of corresponding PCT Application No. PCT/JP2022/035664 dated Nov. 29, 2022.

European Search Report of corresponding EP Application No. 22 88 6547.3 dated Nov. 11, 2024.

International Preliminary Report of corresponding PCT Application No. PCT/JP2022/035664 dated May 16, 2024.

* cited by examiner

SCROLL COMPRESSOR WITH BLOCKING PART FOR OIL SEPARATION

CROSS-REFERENCE TO RELATED APPLICATIONS

This is a continuation of International Application No. PCT/JP2022/035664 filed on Sep. 26, 2022, which claims priority to Japanese Patent Application No. 2021-178785, filed on Nov. 1, 2021. The entire disclosures of these applications are incorporated by reference herein.

BACKGROUND

Technical Field

The present disclosure relates to a shaft seal structure, a compressor, and a refrigeration apparatus.

The present disclosure relates to a compressor and a refrigeration apparatus.

Background Art

A compressor that separates oil mist contained in a gas refrigerant compressed in a casing has been known. In this compressor, a lubricant is supplied to sliding parts of the compression mechanism where the gas refrigerant is compressed. The lubricant that has turned into mist is mixed in the compressed gas refrigerant. For example, Patent Document 1 discloses a technique in which a centrifugal force caused by a swirling flow is used to separate oil from a gas refrigerant.

The compressor of Japanese Unexamined Patent Publication No. 2018-40372 includes a gas guide provided on the inner peripheral surface of a casing. The gas guide has a circumferential guide portion that guides the gas refrigerant in the circumferential direction of the casing. The gas refrigerant guided by the circumferential guide portion forms a swirling flow that flows in a swirling motion in the casing. The swirling flow separates the oil in the gas refrigerant centrifugally. The gas refrigerant is discharged from the compressor to a refrigerant circuit through a discharge pipe.

SUMMARY

A first aspect of the present disclosure is directed to a compressor. The compressor of the first aspect includes a casing, an electric motor housed in the casing, and a compression mechanism driven by the electric motor. The compression mechanism is configured to discharge a gas compressed to an internal space of the casing. The gas discharged from the compression mechanism forms a gas flow that flows in a predetermined direction in the internal space of the casing. A component having a facing surface that faces against the gas flow is arranged in the internal space of the casing. The component is provided with a blocking part configured to block a flow of oil deposited on the facing surface due to a collision of the gas flow.

DETAILED DESCRIPTION OF EMBODIMENT(S)

Figure 1:
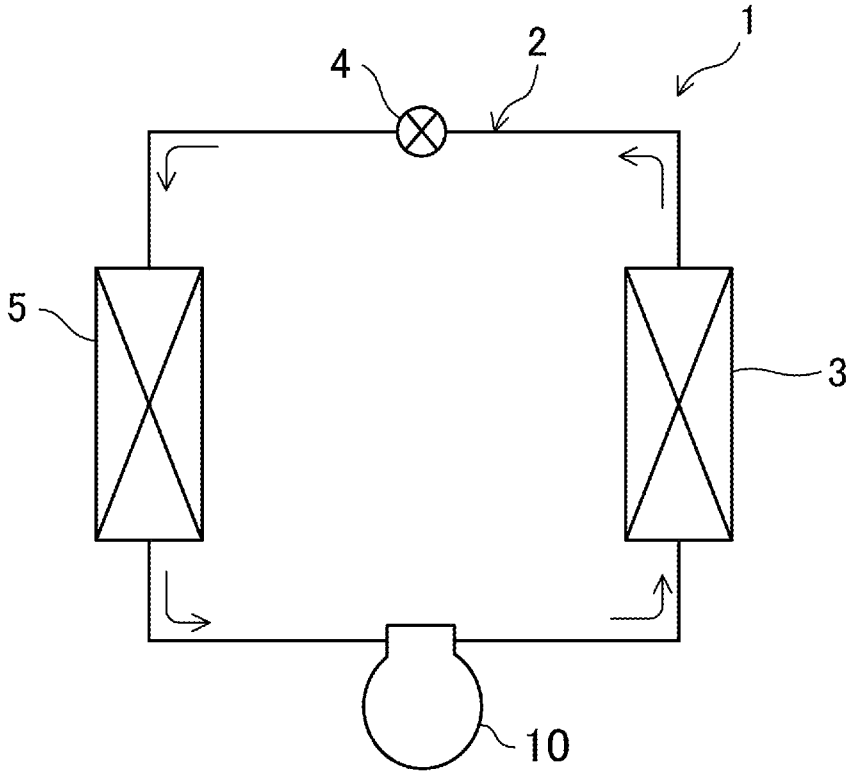
FIG. 1 is a schematic configuration diagram of a refrigerant circuit included in a refrigeration apparatus according to an embodiment.

An illustrative embodiment will be described below in detail with reference to the drawings. In the following embodiment, the technique of the present disclosure applied to a scroll compressor will be described as an example. The drawings are used for conceptual description of the present disclosure. In the drawings, dimensions, ratios, or numbers may be exaggerated or simplified for easier understanding of the technique of the present disclosure.

A compressor (10) according to this embodiment is provided in a refrigeration apparatus (1).

Refrigeration Apparatus

As illustrated in FIG. 1, the refrigeration apparatus (1) includes a refrigerant circuit (2) filled with a refrigerant. The refrigerant circuit (2) includes the compressor (10), a radiator (3), a decompression mechanism (4), and an evaporator (5). The decompression mechanism (4) is an expansion valve, for example. The refrigerant circuit (2) circulates the refrigerant to perform a vapor compression refrigeration cycle.

In the refrigeration cycle, the gas refrigerant compressed by the compressor (10) dissipates heat to the air in the radiator (3). At this time, the refrigerant is liquefied and changed into a liquid refrigerant. The liquid refrigerant having dissipated heat is decompressed by the decompression mechanism (4). The decompressed liquid refrigerant is evaporated in the evaporator (5). At this time, the refrigerant is vaporized and changed into a gas refrigerant. The evaporated gas refrigerant is sucked into the compressor (10). The compressor (10) compresses the sucked gas refrigerant.

The refrigeration apparatus (1) is an air conditioner, for example. The air conditioner may be a cooling and heating machine that switches between cooling and heating. In this case, the refrigerant circuit (2) has a switching mechanism for switching the direction of circulation of the refrigerant. The switching mechanism is a four-way switching valve, for example. The air conditioner may be a device for cooling only or a device for heating only.

The refrigeration apparatus (1) may be a water heater, a chiller unit, or a cooling apparatus configured to cool air in an internal space. The cooling apparatus is for cooling the air inside a refrigerator, a freezer, or a container, for example.

Compressor

As described above, the compressor (10) constitutes the refrigerant circuit (2). The compressor (10) sucks and compresses the low-pressure gas refrigerant. The compressor (10) discharges the compressed high-pressure gas refrigerant. In the following description, a direction along the axis of a drive shaft (50) will be referred to as an "axial direction," a direction perpendicular to the axial direction as a "radial direction," and a direction along the periphery of the drive shaft (50) as a "circumferential direction."

Figure 2:
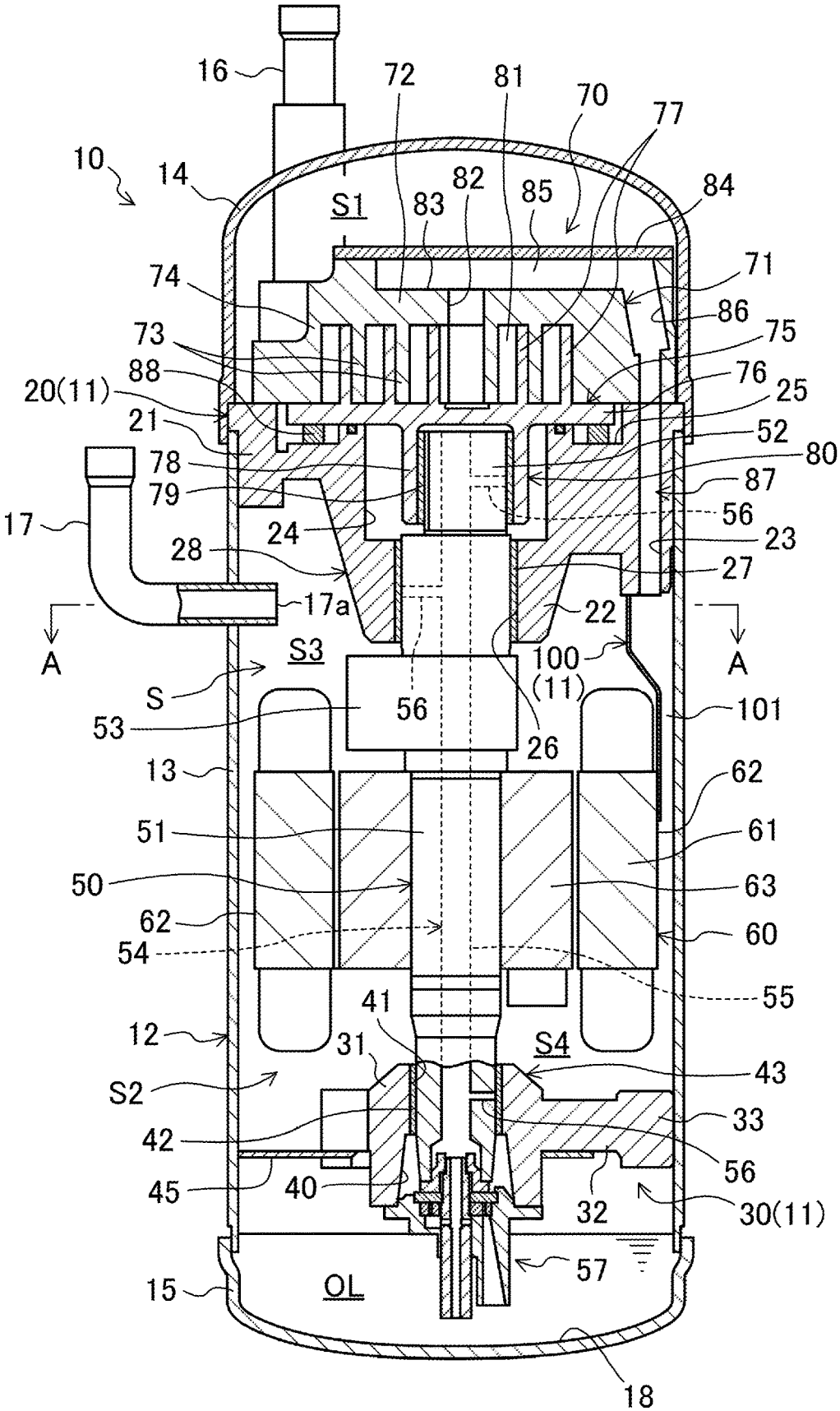
FIG. 2 is a longitudinal cross-sectional view of a compressor according to the embodiment.

The compressor (10) of this example is a high-pressure dome-shaped scroll compressor. As illustrated in FIG. 2, the compressor (10) includes a casing (12), a housing (20), a lower frame (30), a drive shaft (50), an electric motor (60), a compression mechanism (70), an oil return guide (90), and a gas guide (100). The housing (20), the lower frame (30), the drive shaft (50), the electric motor (60), the compression mechanism (70), the oil return guide (90), and the gas guide (100) are housed in the casing (12).

Casing

The casing (12) is configured as a vertically long closed container. The casing (12) includes a barrel (13), an upper end plate (14), and a lower end plate (15). The barrel (13) is in a cylindrical shape. The casing (12) is placed such that the barrel (13) is in an upright position. The upper end plate (14) is welded to an upper end portion of the barrel (13) to close the upper opening of the barrel (13). The lower end plate (15) is welded to a lower end portion of the barrel (13) to close the lower opening of the barrel (13). The casing (12) is hollow and has an internal space (S).

A suction pipe (16) and a discharge pipe (17) are attached to the casing (12). The suction pipe (16) passes through the upper end plate (14) in the axial direction so as to be connected to the compression mechanism (70). The suction pipe (16) communicates with a compression chamber (81) of the compression mechanism (70). The suction pipe (16) sucks a low-pressure gas refrigerant in the refrigerant circuit (2). The discharge pipe (17) passes through the barrel (13) in the radial direction and is open to an upper space (S3) above the electric motor (60) in the casing (12). The discharge pipe (17) discharges the compressed high-pressure gas refrigerant in the casing (12) out of the casing (12).

The casing (12) has, at its bottom, an oil reservoir (18). The oil reservoir (18) stores a lubricant (OL). The lubricant (OL) is used to maintain the lubricity of sliding parts of the compressor (10) such as the compression mechanism (70), an upper bearing (28), a lower bearing (43), and an eccentric bearing (80), which will be described below, during operation of the compressor (10).

Housing

The housing (20) is one of components (11) of the compressor (10). The housing (20) is arranged in an upper portion of the casing (12). The housing (20) is in the shape of a dish with a recessed center. The housing (20) includes a fixed plate portion (21) and a first bearing tube portion (22). The fixed plate portion (21) is an annular portion and forms an upper portion of the housing (20). The first bearing tube portion (22) is a thick tubular portion and protrudes downward from a central portion of the fixed plate portion (21).

The housing (20) is fixed to an upper end portion of the barrel (13) of the casing (12) by press fitting, for example. The outer peripheral surface of the fixed plate portion (21) is in tight contact with the inner peripheral surface of the barrel (13) of the casing (12) throughout the entire circumference. The housing (20) partitions the internal space (S) of the casing (12) into a low-pressure space (S1) and a high-pressure space (S2). The low-pressure space (S1) is a space located above the housing (20). The high-pressure space (S2) is a space located below the housing (20).

An outer peripheral portion of the fixed plate portion (21) has a downstream passage (23). The downstream passage (23) passes through the fixed plate portion (21). The central portion of the fixed plate portion (21) has a first recess (24) that is open upward. The upper surface of the fixed plate portion (21) has an Oldham groove (25) around the outer periphery of the first recess (24). The Oldham groove (25) is in the shape of a circle surrounding the first recess (24).

A first insertion hole (26) is formed in a central portion of the first bearing tube portion (22). The first insertion hole (26) passes through the first bearing tube portion (22) from the bottom of the first recess (24) to the lower end of the first bearing tube portion (22). A first sliding bearing (27) is fitted to the inner surface of the first insertion hole (26). The first bearing tube portion (22) and the first sliding bearing (27) form the upper bearing (28).

Lower Frame

The lower frame (30) is one of the components (11) of the compressor (10). The lower frame (30) is arranged near the lower end of the barrel (13) of the casing (12). As illustrated also in FIG. 8, the lower frame (30) includes a second bearing tube portion (31) and a plurality of leg portions (32). The second bearing tube portion (31) is a thick tubular portion, and is located at the center of a lower space (S4) in the radial direction. The plurality of leg portions (32) are spaced apart from one another in the circumferential direction on the outer periphery of the second bearing tube portion (31). The leg portions (32) extend radially outward from the outer peripheral surface of the second bearing tube portion (31). Each leg portion (32) has a distal end portion (33) located near the outer periphery of the lower space (S4).

The distal end portion (33) of each leg portion (32) is spot-welded to the barrel (13) of the casing (12). Accordingly, the lower frame (30) is fixed to the casing (12). A central portion of a lower portion of the second bearing tube portion (31) has a second recess (40) that is open downward. A second insertion hole (41) is formed in a central portion of the second bearing tube portion (31). The second insertion hole (41) passes through the second bearing tube portion (31) from the bottom of the second recess (40) to the upper end of the second bearing tube portion (31). A second sliding bearing (42) is fitted to the inner surface of the second insertion hole (41). The second bearing tube portion (31) and the second sliding bearing (42) form the lower bearing (43).

An oil separation plate (45) is attached to the lower side of the lower frame (30). The oil separation plate (45) is a member for separating oil (OL) contained in the gas refrigerant. The oil separation plate (45) is formed in a generally annular shape. The oil separation plate (45) is arranged around the second bearing tube portion (31) of the lower frame (30). The oil separation plate (45) is located above the oil reservoir (18). The oil separation plate (45) isolates the oil reservoir (18) from a space in which the gas refrigerant swirls. The oil (OL) separated by the oil separation plate (45) falls into the oil reservoir (18).

Drive Shaft

The drive shaft (50) is a rod-shaped rotating part, and is arranged in a central portion of the internal space (S) such that its axis extends vertically. The drive shaft (50) has a main shaft portion (51) and an eccentric portion (52). The main shaft portion (51) is configured as a cylinder. The eccentric portion (52) is formed in the shape of a relatively short cylinder. The eccentric portion (52) is provided at an upper end of the main shaft portion (51). The eccentric portion (52) has an axis that is substantially parallel to the main shaft portion (51) and eccentric to the axis of the main shaft portion (51). The eccentric portion (52) is housed in the first recess (24) of the housing (20).

The main shaft portion (51) has an upper end portion rotatably supported by the upper bearing (28). The main shaft portion (51) has a lower end portion rotatably supported by the lower bearing (43). The drive shaft (50) is provided with a counterweight (53). The counterweight (53) is a balancer for dynamically balancing with the eccentric portion (52) and other components during rotation of the drive shaft (50). The counterweight (53) is arranged on a portion of the main shaft portion (51) between the compression mechanism (70) and the electric motor (60). An oil supply passage (54) is formed in the drive shaft (50).

The oil supply passage (54) is a passage through which the lubricant (OL) is supplied to the sliding parts of the compressor (10). The oil supply passage (54) includes a main passage (55) and branch passages (56). The main passage (55) extends in the axial direction and has a circular cross section coaxial with the main shaft portion (51). One end of the main passage (55) is open at the lower end of the main shaft portion (51). The lower end of the main shaft portion (51) is located in the second recess (40) of the lower frame (30). The other end of the main passage (55) is open at the upper end of the eccentric portion (52). The branch passages (56) are provided for both upper and lower portions of the main passage (55), and branch from the main passage (55).

An oil pump (57) is provided at a lower end portion of the main shaft portion (51). The oil pump (57) is attached to the lower end of the second bearing tube portion (31) of the lower frame (30), and closes the opening of the second recess (40). The oil pump (57) is a positive-displacement pump. The oil pump (57) is immersed in the lubricant (OL) in the oil reservoir (18). When the drive shaft (50) rotates, the lubricant (OL) in the oil reservoir (18) is pumped up to the oil supply passage (54) by the oil pump (57). The lubricant (OL) pumped up flows through the oil supply passage (54), and is supplied to the compression mechanism (70), the upper bearing (28), the lower bearing (43), and the eccentric bearing (80).

Electric Motor

The electric motor (60) is arranged in the barrel (13) of the casing (12). The electric motor (60) partitions the high-pressure space (S2) in the casing (12) into the upper space (S3) and the lower space (S4). The upper space (S3) is a space between the electric motor (60) and the housing (20). The lower space (S4) is a space below the electric motor (60). The electric motor (60) includes a stator (61) and a rotor (63).

The stator (61) and the rotor (63) are each in a generally cylindrical shape. The stator (61) is fixed to the barrel (13) of the casing (12). The rotor (63) is placed in the hollow of the stator (61). The main shaft portion (51) of the drive shaft (50) is inserted into the hollow of the rotor (63). The rotor (63) is fixed to the main shaft portion (51) of the drive shaft (50). The rotor (63) is substantially coaxial with the main shaft portion (51).

The stator (61) is made of a magnetic material, for example, a stack of steel plates. The stator (61) is provided with a plurality of coils. Each coil converts electric power received by the compressor (10) into magnetic force. The rotor (63) is provided with a plurality of permanent magnets. A slight gap, i.e., a so-called "air gap" is formed between the stator (61) and the rotor (63). The rotor (63) rotates due to interaction between magnetic flux and current between the coils of the stator (61) and the permanent magnets, without coming in contact with the stator (61).

The outer peripheral surface of the stator (61) has a plurality of core cuts (62). The plurality of core cuts (62) are spaced apart from one another in the circumferential direction (see FIG. 8). The core cuts (62) are groove-shaped cutouts that pass vertically through the stator (61). Each core cut (62) forms a gap between the barrel (13) of the casing (12) and the stator (61). A gap formed by one of core cuts (62) functions as a passage through which the gas refrigerant is led downward. A gap formed by another one of the core cuts (62) functions as a passage through which the used lubricant (OL) is led downward.

Compression Mechanism

The compression mechanism (70) is driven by the electric motor (60) via the drive shaft (50). The compression mechanism (70) is a scroll compression mechanism. The compression mechanism (70) includes a fixed scroll (71) and a movable scroll (75). The fixed scroll (71) is arranged on an upper surface of the housing (20). The fixed scroll (71) is fastened to the housing (20) with bolts. Accordingly, the fixed scroll (71) is fixed to the housing (20). The movable scroll (75) is arranged between the fixed scroll (71) and the housing (20). The movable scroll (75) is supported by the housing (20).

The fixed scroll (71) includes a fixed end plate (72), a fixed wrap (73), and an outer peripheral wall (74). The fixed end plate (72) is in the shape of a circular flat plate arranged horizontally. The fixed wrap (73) is in the shape of a wall protruding from the lower surface of the fixed end plate (72). The fixed wrap (73) has a spiral shape that draws an involute curve. The outer peripheral wall (74) protrudes downward from the peripheral portion of the fixed end plate (72). The outer peripheral wall (74) surrounds the outer periphery of the fixed wrap (73). The lower end surface of the outer peripheral wall (74) is in tight contact with the upper surface of the fixed plate portion (21) of the housing (20).

The movable scroll (75) includes a movable end plate (76), a movable wrap (77), and a boss (78). The movable end plate (76) is in the shape of a circular flat plate arranged horizontally. The movable wrap (77) is in the shape of a wall protruding from the upper surface of the movable end plate (76). The movable wrap (77) has a spiral shape that draws an involute curve. The boss (78) has a cylindrical shape protruding downward from the movable end plate (76). The boss (78) is provided on a central portion of the lower surface of the movable end plate (76). A third sliding bearing (79) is fitted to the inner surface of the boss (78).

The eccentric portion (52) of the drive shaft (50) is inserted in the third sliding bearing (79). The boss (78) and the third sliding bearing (79) form the eccentric bearing (80). The fixed wrap (73) of the fixed scroll (71) and the movable wrap (77) of the movable scroll (75) mesh with each other. Thus, the compression chamber (81) is formed between the fixed scroll (71) and the movable scroll (75). The compression chamber (81) is a space surrounded by the fixed end plate (72) and the fixed wrap (73) of the fixed scroll (71) and the movable end plate (76) and the movable wrap (77) of the movable scroll (75). The compression chamber (81) is a space for compressing a gas refrigerant.

The outer peripheral wall (74) of the fixed scroll (71) has a suction port (not shown). The lower end portion of the suction pipe (16) is connected to the suction port. The fixed end plate (72) of the fixed scroll (71) has, at its central portion, a discharge port (82). The discharge port (82) passes through the fixed end plate (72). The upper surface of the fixed end plate (72) has an enlarged recess (83). The discharge port (82) is open at the bottom of the enlarged recess (83).

The upper end opening of the enlarged recess (83) is covered with a cover plate (84). The cover plate (84) is fixed to the fixed end plate (72) with bolts. A high-pressure chamber (85) is formed between the enlarged recess (83) of the fixed scroll (71) and the cover plate (84). The high-pressure chamber (85) is a space into which the high-pressure gas refrigerant from the discharge port (82) flows out. The fixed end plate (72) of the fixed scroll (71) and the cover plate (84) are in tight contact with each other through a gasket (not shown).

The fixed end plate (72) of the fixed scroll (71) has an upstream passage (86). The upstream passage (86) is connected to the downstream passage (23), and forms a connection passage (87) together with the downstream passage (23). The high-pressure chamber (85) communicates with the upper space (S3) in the casing (12) through the connection passage (87). The compression mechanism (70) discharges the compressed gas refrigerant to the upper space (S3) through the connection passage (87).

An Oldham ring (88) is fitted into the Oldham groove (25) of the housing (20). The Oldham ring (88) is arranged between the movable end plate (76) of the movable scroll (75) and the fixed plate portion (21) of the housing (20). The Oldham ring (88) is coupled to a keyway formed on the movable end plate (76) of the movable scroll (75) and a keyway formed on the fixed plate portion (21) of the housing (20). Thus, the Oldham ring (88) restricts the rotation of the movable scroll (75) on its axis while allowing revolution of the movable scroll (75).

Oil Return Guide

Figure 3:
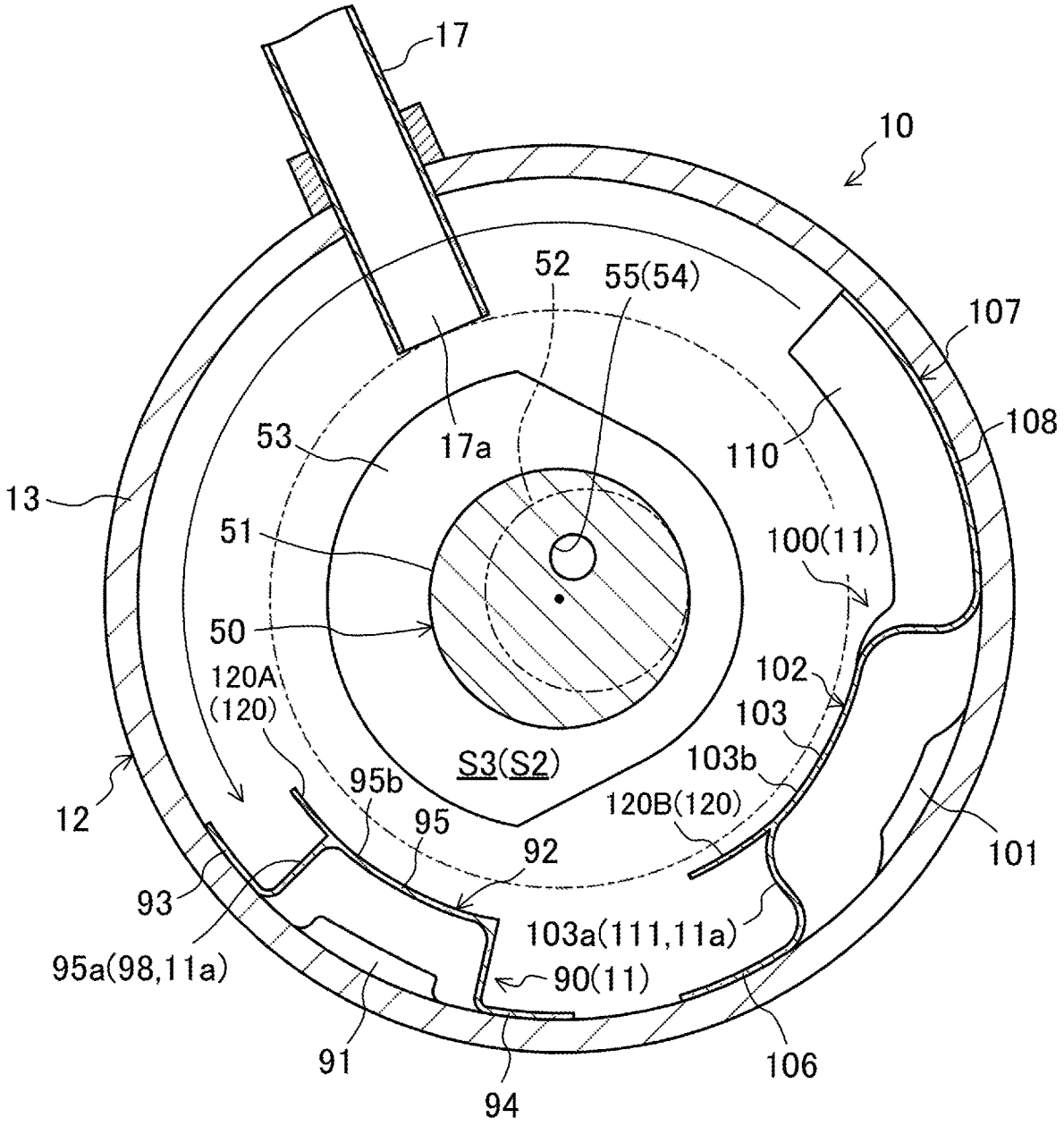
FIG. 3 is a cross-sectional view of the compressor taken along line A-A in FIG. 2.

The oil return guide (90) illustrated in FIG. 3 is one of the components (11) of the compressor (10). The oil return guide (90) is provided between the housing (20) and the stator (61) in the upper space (S3). The oil return guide (90) is a member for guiding the lubricant (OL) supplied to the sliding parts (the upper bearing (28), the compression mechanism (70), and the eccentric bearing (80)) in an upper portion of the compressor (10) downward. The oil return guide (90) is configured as a metallic plate. The oil return guide (90) is fixed to the barrel (13) of the casing (12) by spot welding, for example. The oil return guide (90) is located on the outer periphery side of the upper space (S3).

The oil return guide (90) is arranged above one of the core cuts (62). The oil return guide (90) has a shape that projects inward of the upper space (S3). The oil return guide (90) forms an oil passage (91) together with the inner peripheral surface of the barrel (13) of the casing (12). The lubricant (OL) used in the compression mechanism (70) and other components flows into the oil passage (91). The oil return guide (90) introduces the lubricant (OL) flowing through the oil passage (91) into the one of the core cuts (62) located below the oil return guide (90). The lubricant (OL) introduced into the core cut (62) flows down through the gap between the barrel (13) of the casing (12) and the stator (61) and is collected in the oil reservoir (18).

Gas Guide

The gas guide (100) is one of the components (11) of the compressor (10). The gas guide (100) is arranged between the housing (20) and the stator (61) in the upper space (S3). The gas guide (100) is a member for guiding the gas refrigerant discharged from the compression mechanism (70). The gas guide (100) is configured as a metallic plate. The gas guide (100) is fixed to the barrel (13) of the casing (12) by spot welding, for example. As illustrated also in FIG. 3, the gas guide (100) is located on the outer periphery side of the upper space (S3). The gas guide (100) is spaced apart from the oil return guide (90) in the circumferential direction. The gas guide (100) is arranged above a core cut (62) different from the core cut (62) for the oil return guide (90).

The gas guide (100) has a shape that projects inward of the upper space (S3). The gas guide (100) forms a gas passage (101) together with the inner peripheral surface of the barrel (13) of the casing (12). The upper end opening of the gas passage (101) is connected to the downstream opening of the connection passage (87). The high-pressure gas refrigerant that has flowed through the connection passage (87) flows into the gas passage (101). The gas guide (100) is configured to guide part of the gas refrigerant flowing through the gas passage (101) in the circumferential direction and introduce the remaining part of the gas refrigerant into the associated core cut (62). The lubricant (OL) introduced into the core cut (62) flows down through the gap in the core cut (62) and flows into the lower space (S4).

Operation and Flow of Refrigerant Gas

When the electric motor (60) is actuated by the electric power received in the compressor (10), the compression mechanism (70) is driven by rotation of the drive shaft (50). In the compression mechanism (70) in the driven state, the movable scroll (75) turns around the axis of the drive shaft (50). The low-pressure gas refrigerant that has flowed in from the suction pipe (16) is sucked through the suction port into the compression chamber (81) of the compression mechanism (70) as the movable scroll (75) turns, and is compressed.

The high-pressure gas refrigerant compressed by the compression mechanism (70) is discharged to the high-pressure chamber (85) via the discharge port (82). The high-pressure gas refrigerant discharged into the high-pressure chamber (85) flows through the connection passage (87) formed in the fixed scroll (71) and the housing (20), and flows into the gas passage (101) formed by the gas guide (100). Part of the gas refrigerant is guided by the gas guide (100) to flow downward through the gas passage (101), and flows into the associated core cut (62) of the stator (61).

The gas refrigerant that has passed through the gap formed by the core cut (62) of the stator (61) flows into the lower space (S4), and collides with the oil separation plate (45). This configuration reduces the scatter of the lubricant (OL) caused by the gas refrigerant that has fallen and hits the lubricant (OL) in the oil reservoir (18). Due to the rotation of the rotor (63) of the electric motor (60), the gas refrigerant that has flowed into the lower space (S4) forms a swirling flow in the same direction as the direction of rotation of the rotor (63). The swirling flow of the gas refrigerant in the lower space (S4) is an example of a gas flow flowing in a predetermined direction in the internal space (S) of the casing (12).

The rotation of the counterweight (53) caused by the actuation of the electric motor (60) produces a pumping function. Thus, a portion of the upper space (S3) near the outer periphery of the counterweight (53) has a negative pressure relative to the lower space (S4). Thus, the gas refrigerant flowing through the lower space (S4) flows upward through the gap (air gap) between the stator (61) and the rotor (63) and an air hole (not shown) of the rotor (63) and flows into the upper space (S3).

The remaining part of the gas refrigerant that has flowed into the gas guide (100) flows out into the upper space (S3) in the circumferential direction. The gas refrigerant that has flowed into the upper space (S3) forms a swirling flow in combination with the rotation of the rotor (63) of the electric motor (60), as indicated by the arrow in FIG. 3. Thus, the oil (OL) contained in the gas refrigerant is separated centrifugally. The separated oil (OL) flows downward along the inner peripheral surface of the casing (12) and the surfaces of other components, and is collected in the oil reservoir (18). The swirling flow in the upper space (S3) is an example of a gas flow flowing in a predetermined direction in the internal space (S) of the casing (12).

The gas refrigerant flowing through the upper space (S3) forms a circulating flow which flows sequentially through the core cut (62) of the stator (61), the lower space (S4), the gap (air gap) between the stator (61) and the rotor (63) or the air hole of the rotor (63), and the upper space (S3). The gas refrigerant forming the circulating flow cools the electric motor (60). The gas refrigerant in the upper space (S3) flows into an inflow port (17*a*) of the discharge pipe (17), and is discharged to the refrigerant circuit (2).

In the upper space (S3), the proportion of the gas refrigerant is higher near the center, and the proportion of the oil (OL) is higher near the outer periphery, due to the action of the centrifugal force produced by the swirling flow of the gas refrigerant. In other words, a larger amount of the oil (OL) in the refrigerant gas forming the swirling flow is present near the outer periphery of the upper space (S3). Thus, the oil (OL) in the gas is easily deposited on one side surface (95*a*, 103*a*), of the side surfaces of each of the oil return guide (90) and the gas guide (100), which faces against the swirling flow, due to the collision of the swirling flow.

In the lower space (S4), as well, a larger amount of the oil (OL) in the gas refrigerant forming the swirling flow is present near the outer periphery of the lower space (S4) due to the influence of a centrifugal force. Thus, the oil (OL) in the gas is easily deposited on one side surface (33*a*) which faces against the swirling flow, of the side surfaces of the distal end portion (33) of each leg portion (32) of the lower frame (30), due to the collision of the swirling flow. In the upper space (S3), the oil (OL) in the gas is easily deposited also on a side surface (29*a*) which faces against the swirling flow, of a wall-like portion (29) (described later) of the first bearing tube portion (22) of the housing (20), due to the collision of the swirling flow.

The oil (OL) deposited on the side surfaces (33*a*, 29*a*, 95*a*, 103*a*) of the components (11), such as the oil return guide (90), the gas guide (100), the lower frame (30), and the housing (20), accumulates to form an oil film (OF). The oil film (OF) is exposed to the swirling flow; therefore, without a blocking part (120) which will be described later, the oil film (OF) may flow on the side surfaces (33*a*, 29*a*, 95*a*, 103*a*) of the components (11) and may be scattered again from the surfaces of the components (11) and turn into mist, which may be mixed again in the gas refrigerant forming the swirling flow. If the oil (OL) is scattered again, the frequency of the phenomenon called "oil loss" increases, in which the gas refrigerant is discharged to the outside of the compressor (10) while containing the oil (OL). An increase in the oil loss lowers the efficiency of the compressor (10).

Component for Reducing Oil Scattering Again

The compressor (10) of this example includes a blocking part (120) for each of the oil return guide (90), the gas guide (100), the lower frame (30), and the housing (20), as a component for reducing the oil (OL) scattering again.

Detailed Configuration of Oil Return Guide

Figure 4:
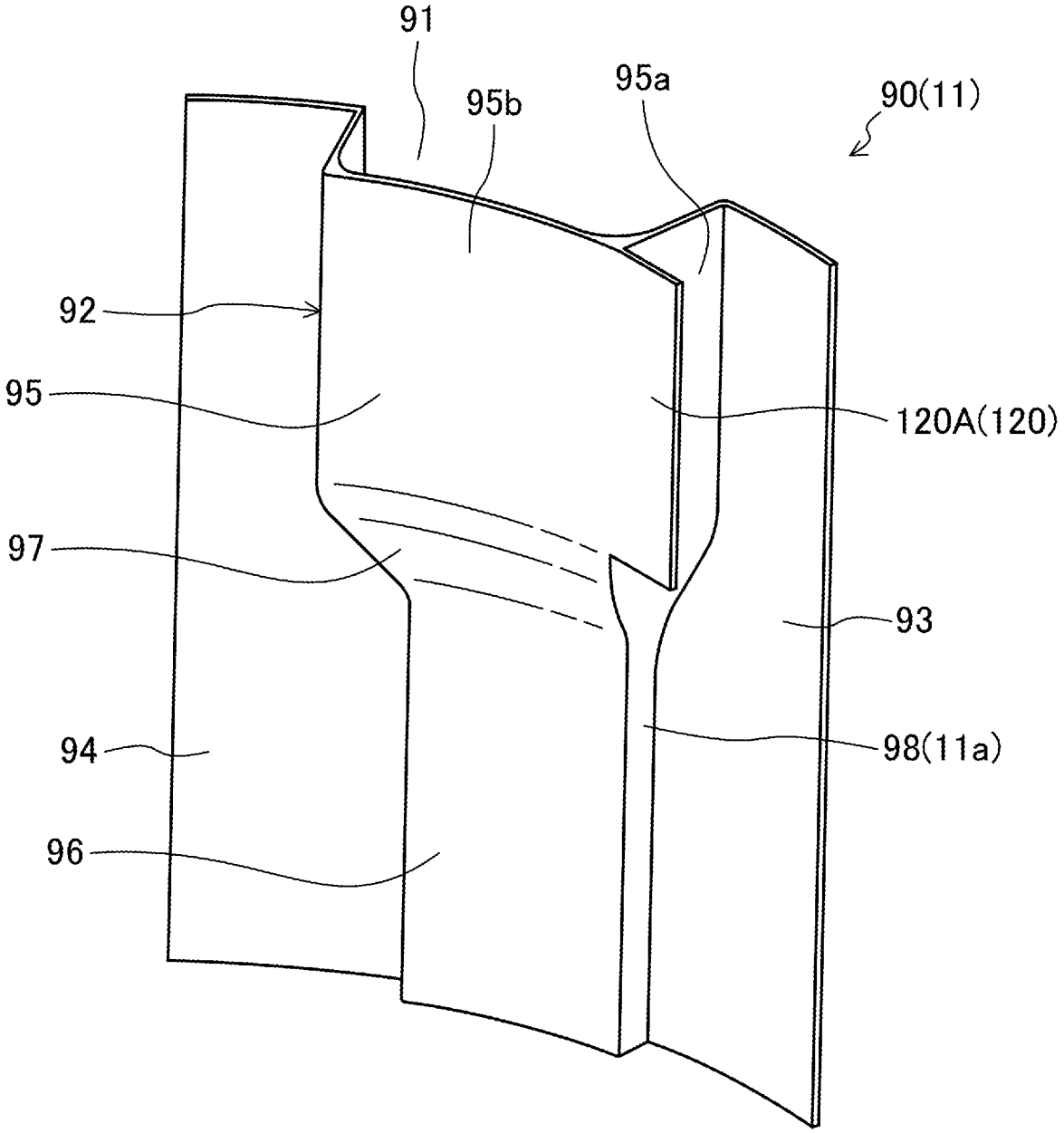
FIG. 4 is a perspective view illustrating, as an example, an oil return guide according to the embodiment.

As illustrated in FIG. 4, the oil return guide (90) includes a recessed portion (92), a first curved plate portion (93), and a second curved plate portion (94). The recessed portion (92) is a portion depressed toward the center of curvature of the first curved plate portion (93) and the second curved plate portion (94). The recessed portion (92) is formed between the first curved plate portion (93) and the second curved plate portion (94).

The recessed portion (92) includes an upper recess (95), a lower recess (96), and an inclined recess (97). The upper recess (95) forms an upper portion of the oil return guide (90). The lower recess (96) forms a lower portion of the oil return guide (90). The bottom of the upper recess (95) is in the shape of a plate that is curved along the outer peripheral surface of the first bearing tube portion (22) of the housing (20). The bottom of the lower recess (96) is in the shape of a plate that is curved with a curvature similar to that of the bottom of the upper recess (95).

The depth of the lower recess (96) is shallower than the depth of the upper recess (95). The width of the lower recess (96) in the circumferential direction is narrower than the width of the upper recess (95) in the circumferential direction. The inclined recess (97) is a portion from the lower end of the upper recess (95) to the upper end of the lower recess (96). The bottom of the inclined recess (97) is inclined with respect to the bottom of the upper recess (95) and the bottom of the lower recess (96) such that the closer to the lower side, the closer to the inner peripheral surface of the barrel (13) of the casing (12).

The recessed portion (92) forms the oil passage (91) extending in the axial direction between the inner peripheral surface of the barrel (13) of the casing (12) and the oil return guide (90). The oil passage (91) is a passage for guiding the oil (OL) that has flowed into the oil return guide (90) downward and introducing the oil (OL) into the core cut (62). The upper end of the oil passage (91) communicates with an oil discharge passage (not shown) provided in the housing (20). The lower end of the oil passage (91) is open toward the core cut (62). In the oil passage (91), the flow path formed by the lower recess (96) is narrower than the flow path formed by the upper recess (95).

The first curved plate portion (93) is a portion continuous with one of circumferential ends of the recessed portion (92). The first curved plate portion (93) is located upstream of the recessed portion (92) with respect to the swirling flow of the gas refrigerant. The second curved plate portion (94) is a portion continuous with the other circumferential end of the recessed portion (92). The second curved plate portion (94) is located downstream of the recessed portion (92) with respect to the swirling flow of the gas refrigerant. The outer peripheral surface of the first curved plate portion (93) and the outer peripheral surface of the second curved plate portion (94) are entirely in tight contact with the inner peripheral surface of the barrel (13) of the casing (12).

Figure 5:
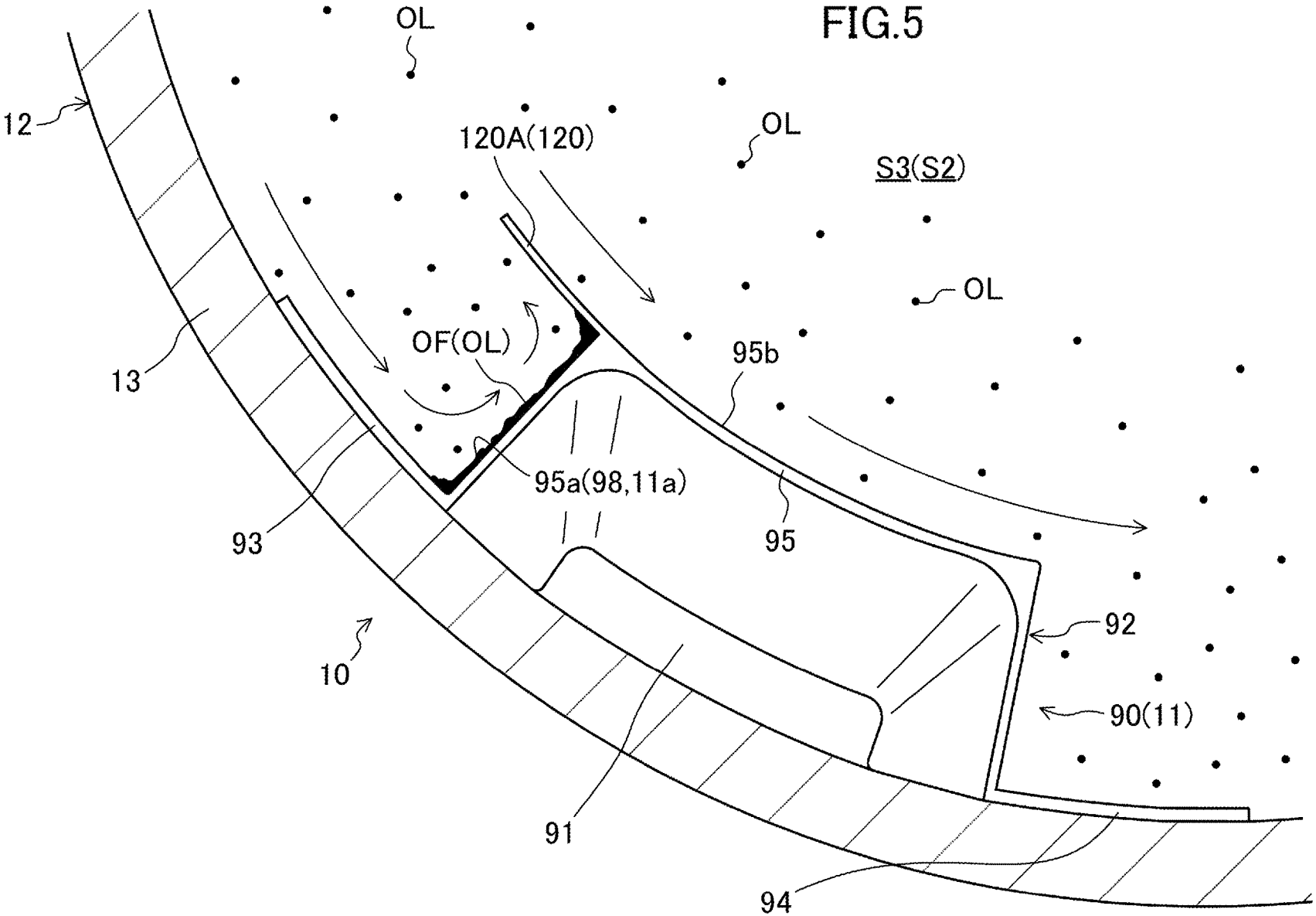
FIG. 5 is a cross-sectional view illustrating, as an example, a flow of a gas refrigerant through the oil return guide of the embodiment and its surrounding area.

The oil return guide (90) has a facing surface (98) that faces against the swirling flow of the gas refrigerant in the upper space (S3). The facing surface (98) corresponds to a facing surface (11*a*) of the component (11). The facing surface (98) includes a side surface (95*a*) of the upper recess (95) near the first curved plate portion (93). The side surface (95*a*) of the oil return guide (90) faces in the circumferential direction of the casing (12). As illustrated in FIG. 5, the swirling flow of the gas refrigerant (indicated by the arrows in FIG. 5) collides with the side surface (95*a*) of the oil return guide (90), resulting in deposition of the oil (OL) in the gas refrigerant on the side surface (95*a*) and formation of an oil film (OF).

The oil return guide (90) is provided with a first blocking plate (120A). The first blocking plate (120A) is an example of the blocking part (120). The first blocking plate (120A) is integrated with the oil return guide (90). The first blocking plate (120A) is provided on a portion of the surface of the upper recess (95) of the oil return guide (90) shaped to change the direction of flow of the gas refrigerant. Specifically, the portion of the oil return guide (90) where the first blocking plate (120A) is provided is a bent portion connecting the side surface (95*a*) and an outer surface (95*b*) of the bottom of the upper recess (95).

The first blocking plate (120A) is a plate-like object protruding in the direction to which the side surface (95*a*) of the oil return guide (90) faces. The first blocking plate (120A) is arranged so as to be closer to the outside in the radial direction of the casing (12) than the inflow port (17*a*) of the discharge pipe (17) (the position indicated by the dash-dot line in FIG. 3). The first blocking plate (120A) faces the first curved plate portion (93) in the radial direction. The first blocking plate (120A) is in the posture directly facing the first curved plate portion (93).

The upper recess (95), the first curved plate portion (93), and the first blocking plate (120A) form a dead end that interrupts the flow of the gas refrigerant in the circumferential direction. The first blocking plate (120A) blocks the flow of the oil (OL) deposited on the side surface of the oil return guide (90). The gas refrigerant that has entered the dead end flows downward. The oil (OL) deposited on the side surface (95*a*) of the oil return guide (90) flows downward along the side surface of the recessed portion (92).

Detailed Configuration of Gas Guide

Figure 6:
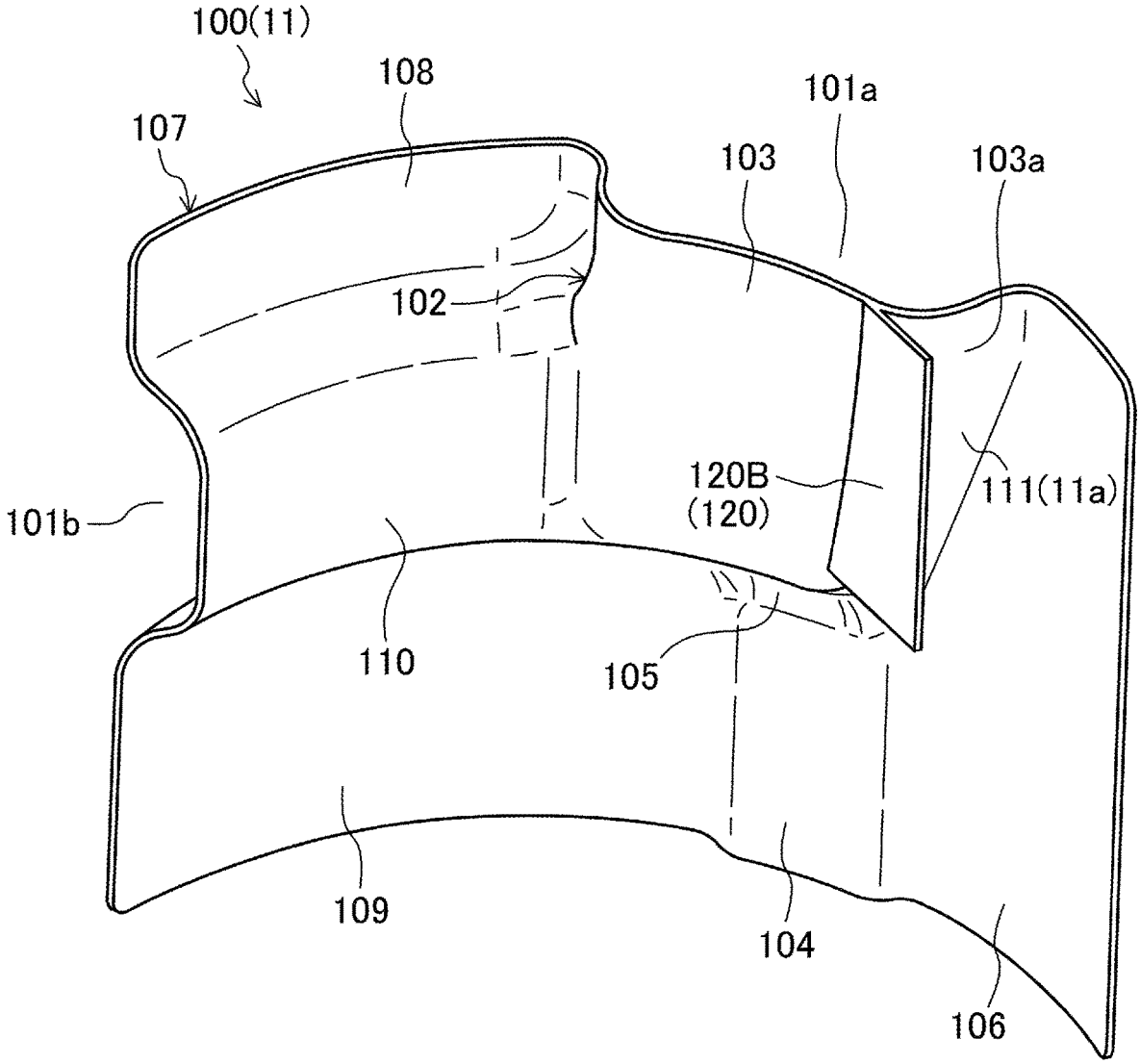
FIG. 6 is a perspective view illustrating, as an example, a gas guide according to the embodiment.

As illustrated in FIG. 6, the gas guide (100) includes a recessed portion (102), a first curved plate portion (106), and a second curved plate portion (107). The recessed portion (102) is a portion depressed toward the center of curvature of the first curved plate portion (106) and the second curved plate portion (107). The recessed portion (102) forms the gas passage (101). The recessed portion (102) is formed between the first curved plate portion (106) and the second curved plate portion (107).

The recessed portion (102) includes an upper recess (103), a lower recess (104), and an inclined recess (105). The upper recess (103) forms an upper portion of the gas guide (100). The lower recess (104) forms a lower portion of the gas guide (100). The bottom of the upper recess (103) is formed in the shape of a plate that is curved along the outer peripheral surface of the first bearing tube portion (22) of the housing (20). The bottom of the lower recess (104) is formed in the shape of a plate that is curved with a curvature similar to that of the bottom of the upper recess (103).

The depth of the lower recess (104) is shallower than the depth of the upper recess (103). The width of the lower recess (104) in the circumferential direction is narrower than the width of the upper recess (103) in the circumferential direction. The inclined recess (105) is a portion from the lower end of the upper recess (103) to the upper end of the lower recess (104). The bottom of the inclined recess (105) is inclined with respect to the bottom of the upper recess (103) and the bottom of the lower recess (104) such that the closer to the lower side, the closer to the inner peripheral surface of the casing (12).

The recessed portion (102) forms an axial passage (101*a*) extending in the axial direction between the gas guide (100) and the inner peripheral surface of the barrel (13) of the casing (12). The axial passage (101*a*) is a portion of the gas passage (101), and is a passage for guiding part of the gas refrigerant that has flowed into the gas guide (100) downward and introducing the part of the gas refrigerant into the core cut (62). The upper end of the axial passage (101*a*) is connected to the connection passage (87). The lower end of the axial passage (101*a*) is open toward the core cut (62). In the axial passage (101*a*), the flow path formed by the lower recess (104) is narrower than the flow path formed by the upper recess (103).

The first curved plate portion (106) is a portion continuous with one of circumferential ends of the recessed portion (102). The first curved plate portion (106) is located upstream of the recessed portion (102) with respect to the swirling flow of the gas refrigerant. The outer peripheral surface of the first curved plate portion (106) is entirely in tight contact with the inner peripheral surface of the barrel (13) of the casing (12). The width of the first curved plate portion (106) in the circumferential direction is narrower than the width of the second curved plate portion (107) in the circumferential direction.

The second curved plate portion (107) is a portion continuous with the other circumferential end of the recessed portion (102). The second curved plate portion (107) is located downstream of the recessed portion (102) with respect to the swirling flow of the gas refrigerant. The second curved plate portion (107) includes an upper curved portion (108), a lower curved portion (109), and an intermediate recess (110). The upper curved portion (108) forms an upper portion of the second curved plate portion (107). The lower curved portion (109) forms a lower portion of the second curved plate portion (107). The outer peripheral surface of the upper curved portion (108) and the outer peripheral surface of the lower curved portion (109) are entirely in tight contact with the inner peripheral surface of the barrel (13) of the casing (12).

The intermediate recess (110) is recessed toward the center of curvature of the second curved plate portion (107). The intermediate recess (110) is formed between the upper curved portion (108) and the lower curved portion (109). The intermediate recess (110) extends along the entire circumferential length of the second curved plate portion (107). One end of the intermediate recess (110) is open to the inside of the recessed portion (102). The other end of the intermediate recess (110) is open to the upper space (S3). The intermediate recess (110) forms a circumferential passage (101*b*) extending in the circumferential direction between the second curved plate portion (107) and the inner peripheral surface of the barrel (13) of the casing (12). The circumferential passage (101*b*) communicates with the axial passage (101*a*).

Figure 7:
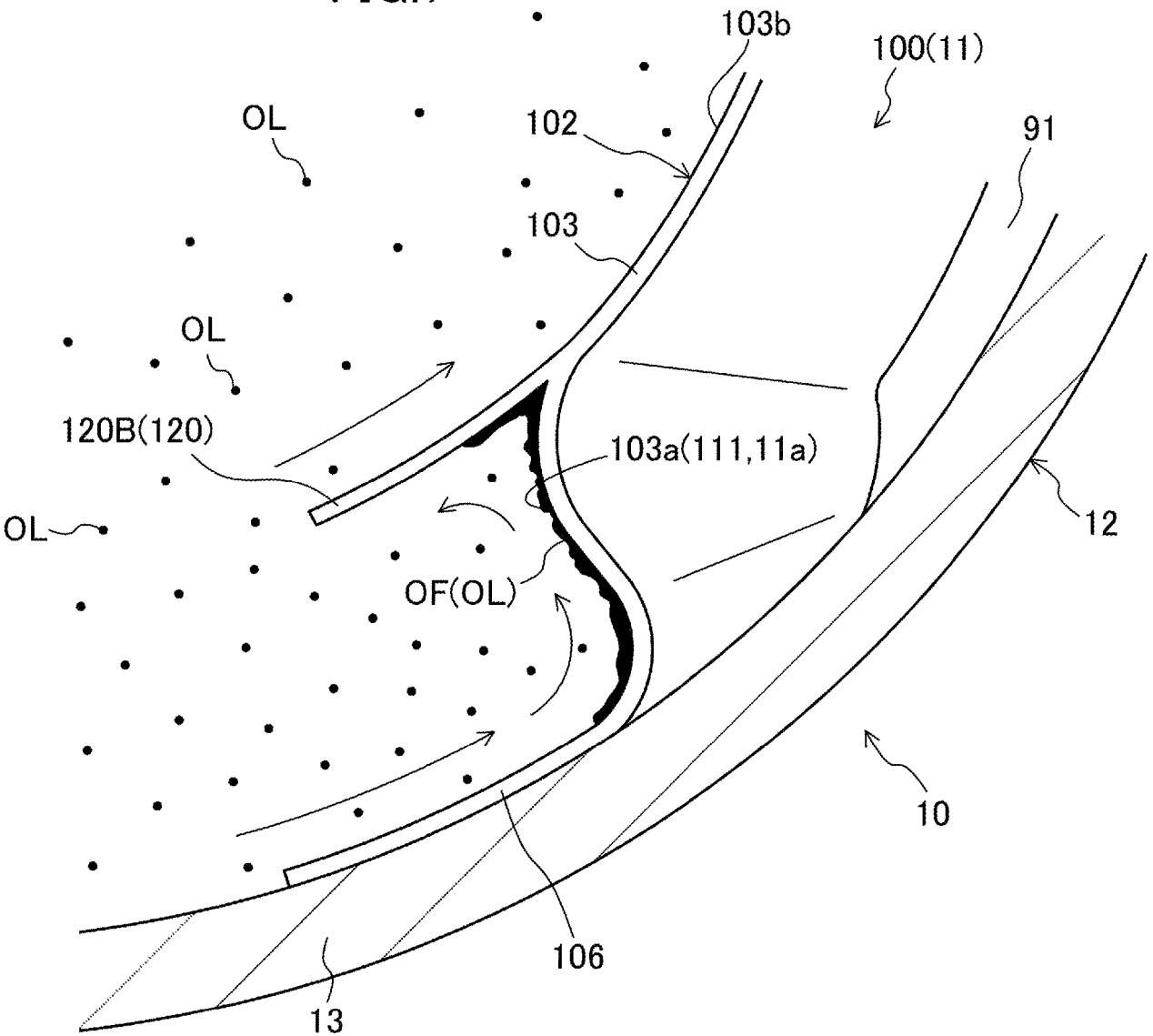
FIG. 7 is a cross-sectional view illustrating, as an example, the flow of the gas refrigerant through an essential portion of the gas guide of the embodiment and its surrounding area.

The gas guide (100) has a facing surface (111) that faces against the swirling flow of the gas refrigerant in the upper space (S3). The facing surface (111) corresponds to a facing surface (11*a*) of the component (11). The facing surface (111) includes a side surface (103*a*) of the upper recess (103) near the first curved plate portion (106). The side surface (103*a*) of the gas guide (100) faces in the circumferential direction of the casing (12). As illustrated in FIG. 7, the swirling flow of the gas refrigerant (indicated by the arrows in FIG. 7) collides with the side surface (103*a*) of the gas guide (100), resulting in deposition of the oil (OL) in the gas refrigerant on the side surface (103*a*) and formation of an oil film (OF).

The gas guide (100) is provided with a second blocking plate (120B). The second blocking plate (120B) is an example of the blocking part (120). The second blocking plate (120B) is integrated with the gas guide (100). The second blocking plate (120B) is provided on a portion of the surface of the upper recess (103) of the gas guide (100) shaped to change the direction of flow of the gas refrigerant. Specifically, the portion of the gas guide (100) where the second blocking plate (120B) is provided is a bent portion connecting the side surface (103*a*) and an outer surface (103*b*) of the bottom of the upper recess (103).

The second blocking plate (120B) is a plate-like object protruding in the direction to which the side surface (103*a*) of the gas guide (100) faces. The second blocking plate (120B) is arranged so as to be closer to the outside in the radial direction of the casing (12) than the inflow port (17*a*) of the discharge pipe (17) (the position indicated by the dash-dot line in FIG. 3). The second blocking plate (120B) faces the first curved plate portion (106) in the radial direction. The second blocking plate (120B) is in the posture directly facing the first curved plate portion (106).

The upper recess (103), the first curved plate portion (106), and the second blocking plate (120B) form a dead end that interrupts the flow of the gas refrigerant in the circumferential direction. The second blocking plate (120B) blocks the flow of the oil deposited on the side surface of the gas guide (100). The gas refrigerant that has entered the dead end flows downward. The oil (OL) deposited on the side surface (103*a*) of the gas guide (100) flows downward along the side surface of the recessed portion (102).

Detailed Configurations of Lower Frame and Oil Separation Plate

Figure 8:
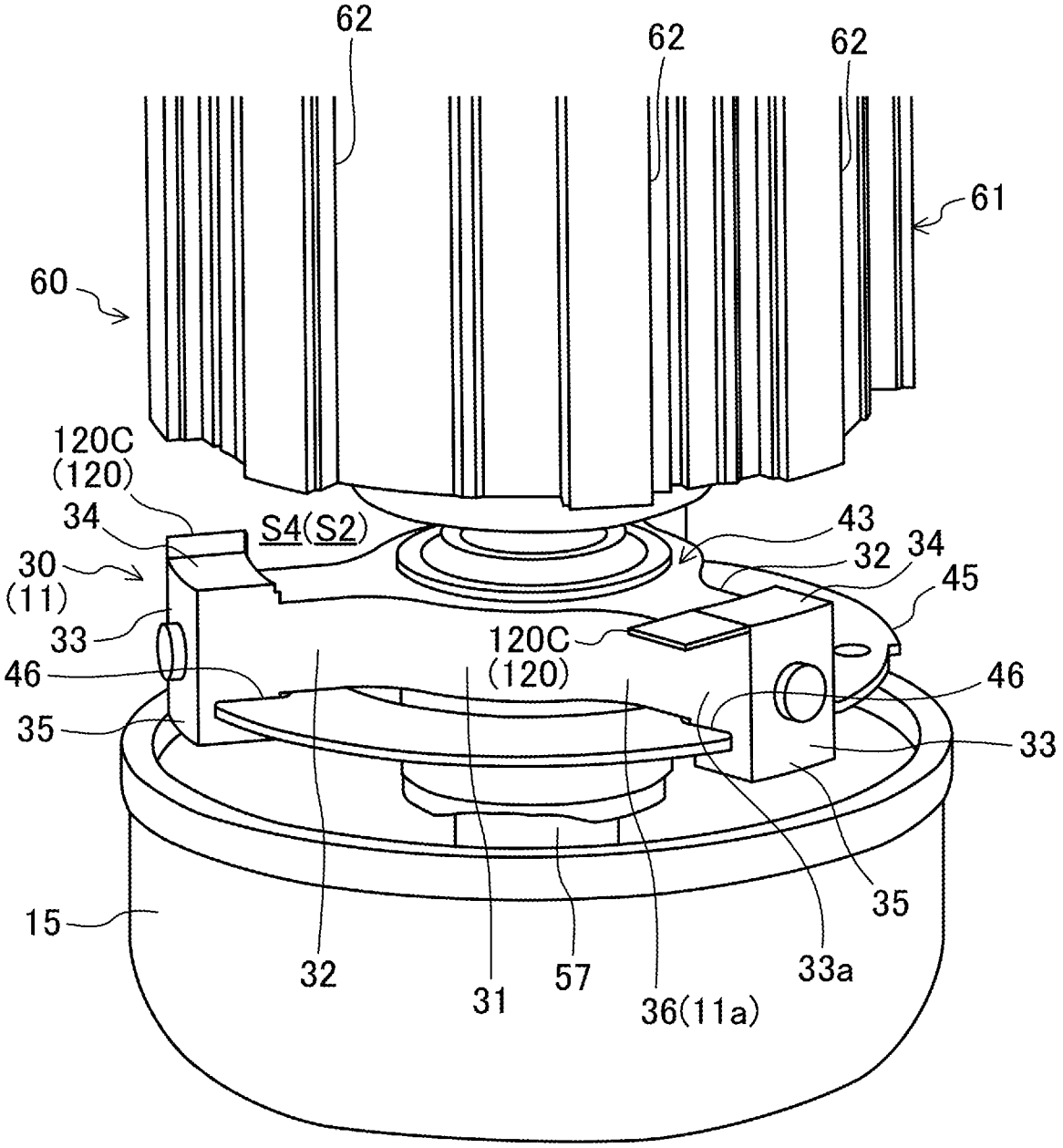
FIG. 8 is a perspective view illustrating, as an example, the structure of a lower portion of the compressor according to the embodiment.
Figure 9:
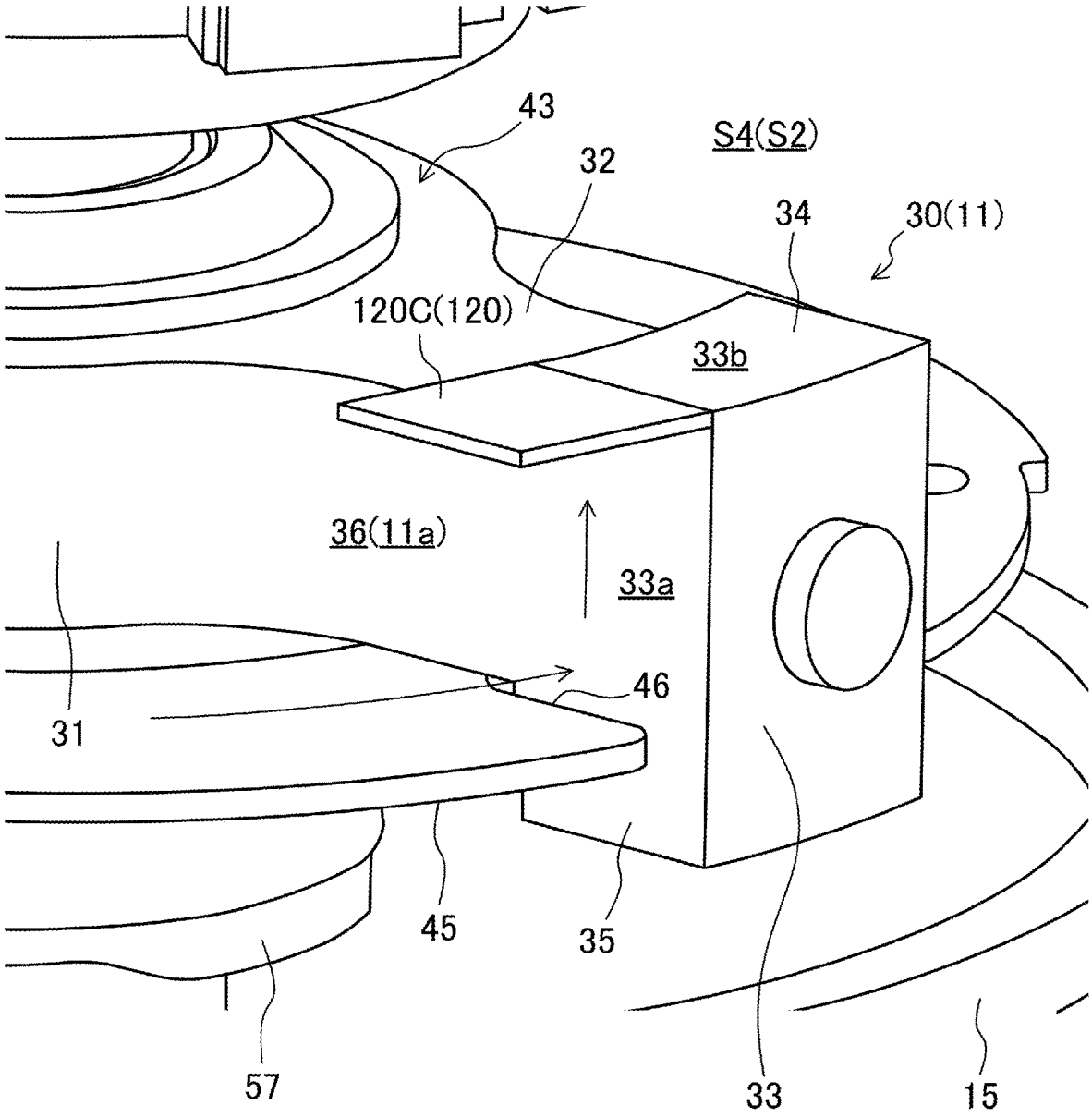
FIG. 9 is a perspective view illustrating, as an example, an essential portion of a lower frame of the embodiment and its surrounding area.

As illustrated in FIGS. 8 and 9, the distal end portion (33) of each of the leg portions (32) of the lower frame (30) has an upper protrusion (34) and a lower protrusion (35). The upper protrusion (34) is a portion protruding upward as compared to the other portion between the upper protrusion (34) and the second bearing tube portion (31). The lower protrusion (35) is a portion protruding downward as compared to the other portion between the lower protrusion (35) and the second bearing tube portion (31). The lower frame (30) has a facing surface (36) that faces against the swirling flow of the gas refrigerant in the lower space (S4). The facing surface (36) corresponds to a facing surface (11*a*) of the component (11). The facing surface (36) includes one side surface (33*a*) of the side surfaces of the distal end portion (33) of each leg portion (32).

The oil separation plate (45) is attached to the lower side of the lower frame (30). A peripheral portion of the oil separation plate (45) has a plurality of fitting holes (46). The fitting holes (46) are located at positions that correspond to the distal end portions (33) of the leg portions (32) of the lower frame (30). The fitting holes (46) are cutouts that are open outward in the radial direction. The lower protrusion (35) of each of the leg portions (32) of the lower frame (30) is fitted into the associated one of fitting holes (46). The swirling flow of the gas refrigerant in the lower space (S4) flows along the upper surface of the oil separation plate (45) between adjacent leg portions (32) of the lower frame (30), as indicated by the arrow in FIG. 9.

Figure 10:
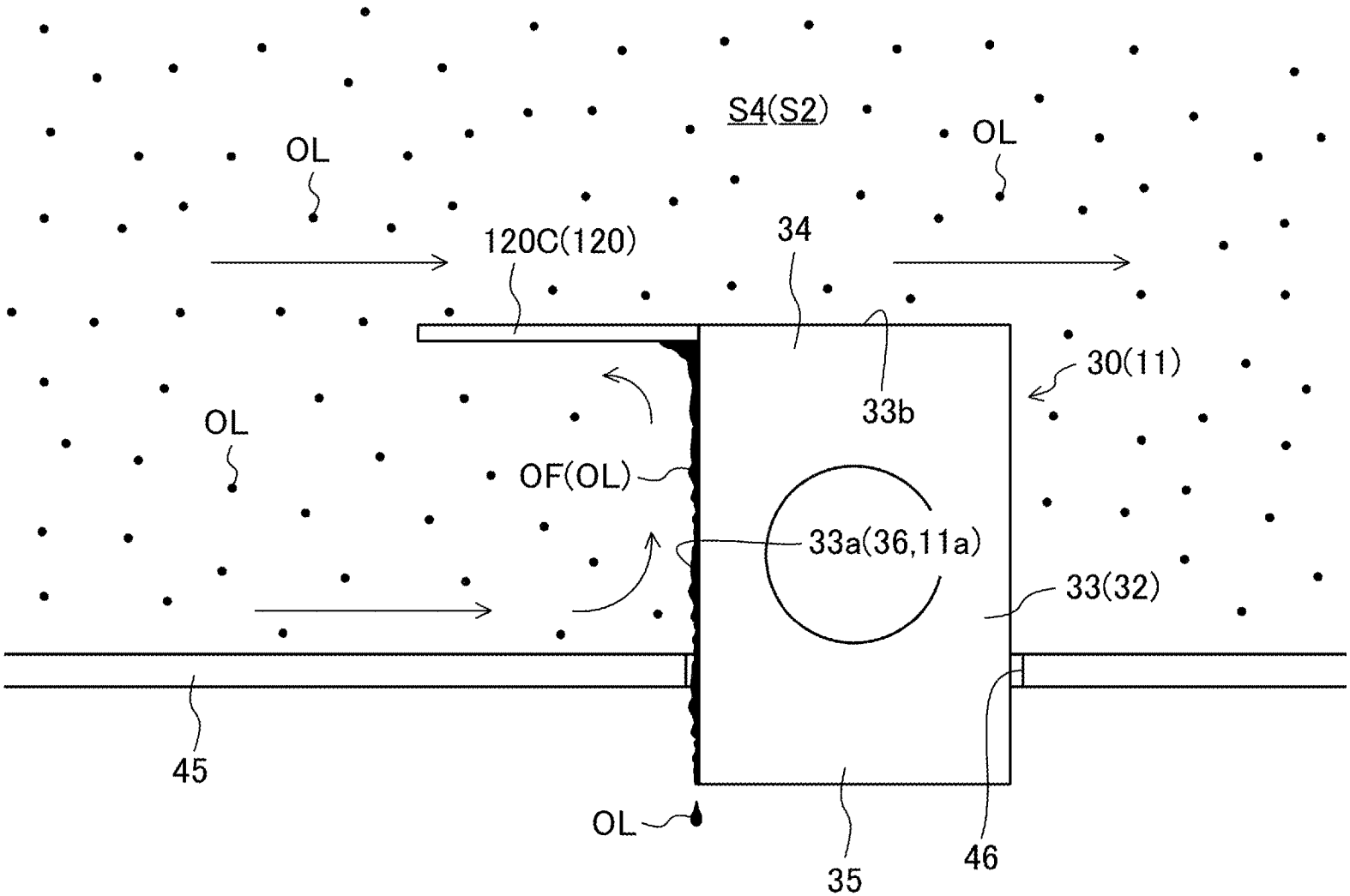
FIG. 10 is a side view illustrating, as an example, the flow of the gas refrigerant through the essential portion of the lower frame of the embodiment and its surrounding area.

The side surface (33*a*) which forms the facing surface (36) at the distal end portion (33) of each leg portion (32) of the lower frame (30) faces in the circumferential direction. As illustrated in FIG. 10, the swirling flow of the gas refrigerant (indicated by the arrows in FIG. 10) collides with the side surface (33*a*) of the distal end portion (33) of each leg portion (32) of the lower frame (30), resulting in deposition of the oil (OL) in the gas refrigerant on the side surface (33*a*) and formation of an oil film (OF). Each leg portion (32) of the lower frame (30) is provided with a third blocking plate (120C). The third blocking plate (120C) is an example of the blocking part (120).

The third blocking plate (120C) is configured as a separate member from the lower frame (30). The third blocking plate (120C) is joined to the distal end portion (33) of the leg portion (32) by welding, for example, and integrated with the leg portion (32). The third blocking plate (120C) is provided on a portion of the surface of the distal end portion (33) of the leg portion (32) shaped to change the direction of flow of the gas refrigerant. Specifically, a portion of each leg portion (32) of the lower frame (30) where the third blocking plate (120C) is provided is a corner portion formed between an upper surface (33*b*) and the side surface (33*a*) of the distal end portion (33) of the leg portion (32). The third blocking plate (120C) is a plate-like object protruding in the direction to which the side surface (33*a*) of the distal end portion (33) of the leg portion (32) faces.

The third blocking plate (120C) faces the oil separation plate (45) in the axial direction. The leg portion (32) of the lower frame (30), the third blocking plate (120C), and the oil separation plate (45) form a dead end that interrupts the flow of the refrigerant gas in the circumferential direction. The third blocking plate (120C) blocks the flow of the oil (OL) deposited on the side surface (33*a*) of the leg portion (32) of the lower frame (30). The gas refrigerant that has entered the dead end flows inward in the radial direction. The oil (OL) deposited on the side surface (33*a*) of the distal end portion (33) of each leg portion (32) flows downward along the side surface of the lower protrusion (35).

Configuration of Essential Portion of Housing

Figure 11:
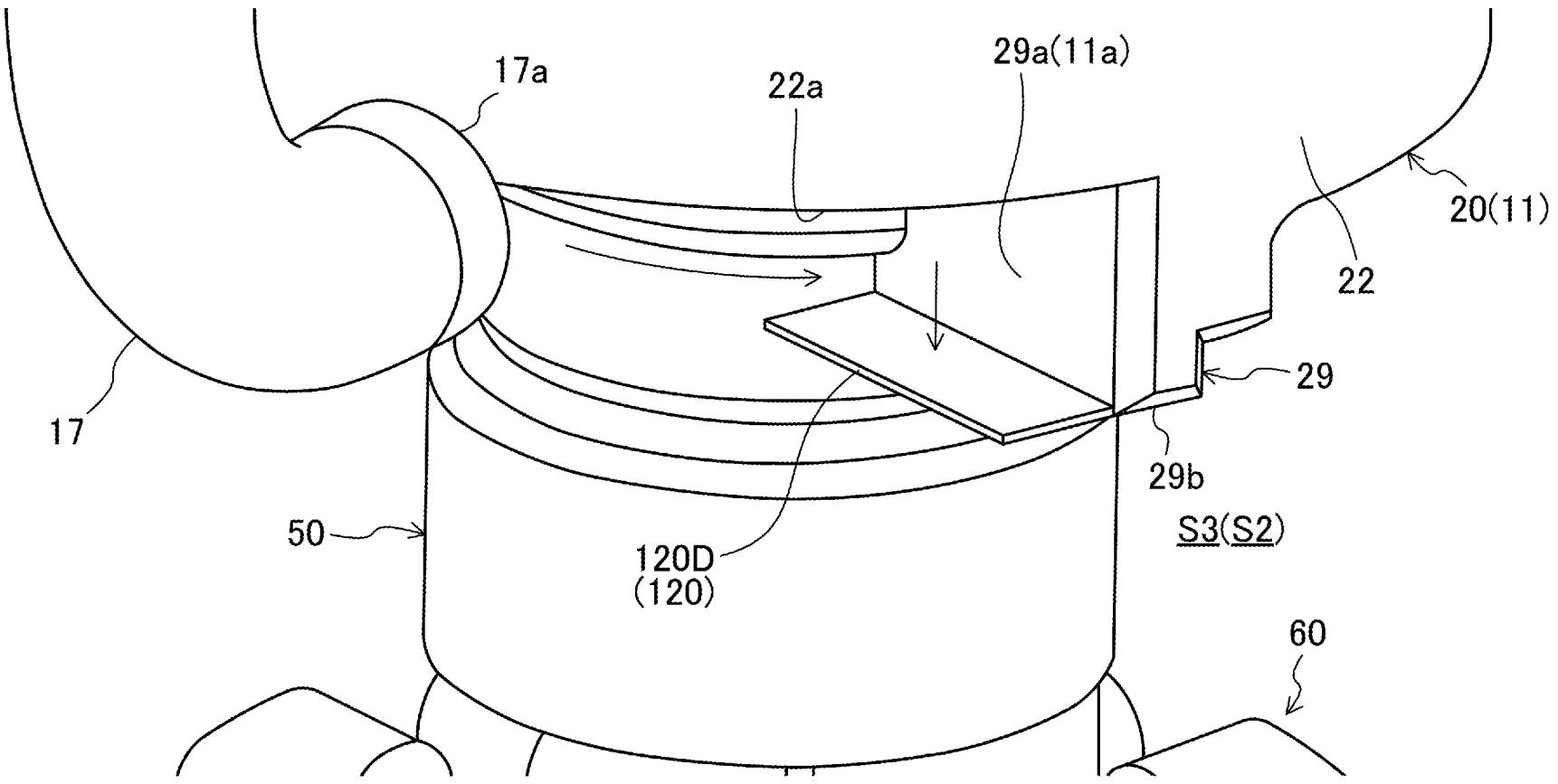
FIG. 11 is a perspective view illustrating, as an example, an essential portion of a compression mechanism of the embodiment and its surrounding area.
Figure 12:
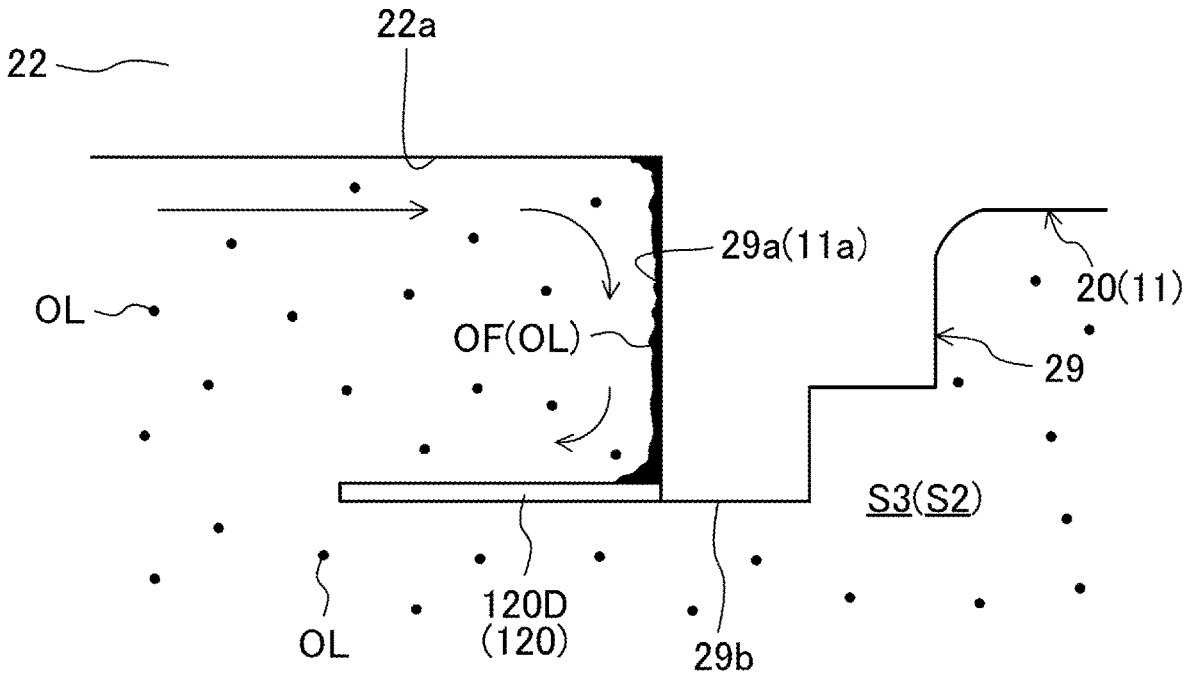
FIG. 12 is a side view illustrating, as an example, the flow of the gas refrigerant through the essential portion of the compression mechanism of the embodiment and its surrounding area.

As illustrated in FIG. 11, the outer peripheral surface of the first bearing tube portion (22) of the housing (20) is provided with a wall-like portion (29). The wall-like portion (29) protrudes outward in the radial direction. The wall-like portion (29) has a side surface (29*a*) serving as a facing surface that faces against the swirling flow of the gas refrigerant in the upper space (S3). The side surface (29*a*) faces in the circumferential direction. As illustrated in FIG. 12, the swirling flow of the gas refrigerant (indicated by the arrows in FIG. 12) collides with the side surface (29*a*) of the wall-like portion (29), resulting in deposition of the oil (OL) in the gas refrigerant on the side surface (29*a*) and formation of an oil film (OF). The wall-like portion (29) of the housing (20) is provided with a fourth blocking plate (120D). The fourth blocking plate (120D) is an example of the blocking part (120).

The fourth blocking plate (120D) is configured as a separate member from the housing (20). The fourth blocking plate (120D) is joined to the housing (20) by welding, for example, and integrated with the housing (20). The fourth blocking plate (120D) is provided on a portion of the wall-like portion (29) of the housing (20) shaped to change the direction of flow of the gas refrigerant. Specifically, a portion of the housing (20) where the fourth blocking plate (120D) is provided is a corner portion formed between the side surface (29*a*) and a lower surface (29*b*) of the wall-like portion (29). The fourth blocking plate (120D) is a plate-like object protruding in the direction to which the side surface (29*a*) of the wall-like portion (29) of the housing (20) faces.

The fourth blocking plate (120D) faces, in the axial direction, a downward-facing lower surface (22*a*) of the first bearing tube portion (22) of the housing (20). The lower surface (22*a*) of the first bearing tube portion (22), the wall-like portion (29), and the fourth blocking plate (120D)

form a dead end that interrupts the flow of the refrigerant gas in the circumferential direction. The fourth blocking plate (120D) blocks the flow of the oil (OL) deposited on the side surface (29*a*) of the wall-like portion (29). The gas refrigerant that has entered the dead end flows outward in the radial direction. The oil (OL) deposited on the side surface (29*a*) of the wall-like portion (29) flows downward.

Features of Embodiment

In the compressor (10) of this embodiment, the first blocking plate (120A) is provided for the oil return guide (90). The oil (OL) deposited on the side surface (95*a*) of the oil return guide (90), the side surface (95*a*) serving as the facing surface (98), flows due to the swirling flow of the gas refrigerant. Such a flow of the oil (OL) is blocked by the first blocking plate (120A). It is thus possible to reduce the chances in which the oil (OL) deposited on the side surface (95*a*) of the oil return guide (90) is scattered again from the surface of the oil return guide (90) and mixed again in the gas refrigerant. This makes it possible to reduce the oil loss in the compressor (10).

In the compressor (10) of this embodiment, the second blocking plate (120B) is provided for the gas guide (100). The oil (OL) deposited on the side surface (103*a*) of the gas guide (100), the side surface (103*a*) serving as the facing surface (111), flows due to the swirling flow of the gas refrigerant. Such a flow of the oil (OL) is blocked by the second blocking plate (120B). It is thus possible to reduce the chances in which the oil (OL) deposited on the side surface (103*a*) of the gas guide (100) is scattered again from the surface of the gas guide (100) and mixed again in the gas refrigerant. This also makes it possible to reduce the oil loss in the compressor (10).

In the compressor (10) of this embodiment, the third blocking plate (120C) is provided for the distal end portion (33) of each of the leg portions (32) of the lower frame (30). The oil (OL) deposited on the side surface (33*a*) of the distal end portion (33) of each leg portion (32) of the lower frame (30), the side surface (33*a*) serving as the facing surface (36), flows due to the swirling flow of the gas refrigerant. Such a flow of the oil (OL) is blocked by the third blocking plate (120C). It is thus possible to reduce the chances in which the oil (OL) deposited on the side surface (33*a*) of the distal end portion (33) of each leg portion (32) of the lower frame (30) is scattered again from the surface of the leg portion (32) and mixed again in the gas refrigerant. This also makes it possible to reduce the oil loss in the compressor (10).

In the compressor (10) of this embodiment, the fourth blocking plate (120D) is provided for the wall-like portion (29) of the housing (20). The oil (OL) deposited on the side surface (29*a*) of the wall-like portion (29) of the housing (20) flows due to the swirling flow of the gas refrigerant. Such a flow of the oil (OL) is blocked by the fourth blocking plate (120D). It is thus possible to reduce the chances in which the oil (OL) deposited on the side surface (29*a*) of the wall-like portion (29) of the housing (20) is scattered again from the surface of the wall-like portion (29) and mixed again in the gas refrigerant. This also makes it possible to reduce the oil loss in the compressor (10).

In the compressor (10) of this embodiment, each of the blocks (120) is a plate-like object, and protrudes in the direction to which the side surface (95*a*, 103*a*, 33*a*, 29*a*) of the component (11) faces against the swirling flow of the gas refrigerant. These blocks (120) serve as walls suitable for blocking the flow of the oil (OL) that forms the oil film (OF) on the side surface (95*a*) of the oil return guide (90), the side surface (103*a*) of the gas guide (100), the side surface (33*a*) of the distal end portion (33) of each of the leg portions (32) of the lower frame (30), and the side surface (29*a*) of the wall-like portion (29) of the housing (20).

In the compressor (10) of this embodiment, the first blocking plate (120A) is integrated with the oil return guide (90). This configuration eliminates the need for the work of attaching a separate member serving as the first blocking plate (120A) to the oil return guide (90) to provide the blocking part (120). Further, the second blocking plate (120B) is integrated with the gas guide (100). This configuration eliminates the need for the work of attaching a separate member serving as the second blocking plate (120B) to the gas guide (100) to provide the blocking part (120).

In the compressor (10) of this embodiment, the third blocking plate (120C) is provided as a separate member from the lower frame (30). If the third blocking plate (120C) is a separate member from the lower frame (30), the degree of freedom in the shape of the third blocking plate (120C) is higher compared to the case in which the third blocking plate (120C) is integrated with the lower frame (30). Further, the fourth blocking plate (120D) is a separate member from the housing (20). If the fourth blocking plate (120D) is a separate member from the housing (20), the degree of freedom in the shape of the fourth blocking plate (120D) is higher compared to the case in which the fourth blocking plate (120D) is integrated with the housing (20).

The refrigeration apparatus (1) of this embodiment includes the compressor (10) described above. The oil loss is reduced in the compressor (10). It is thus possible to improve the efficiency of the compressor (10). The compressor (10), since used for the refrigerant circuit (2), contributes to improving efficiency of the refrigeration cycle performed in the refrigerant circuit (2).

First Variation

Figure 13:
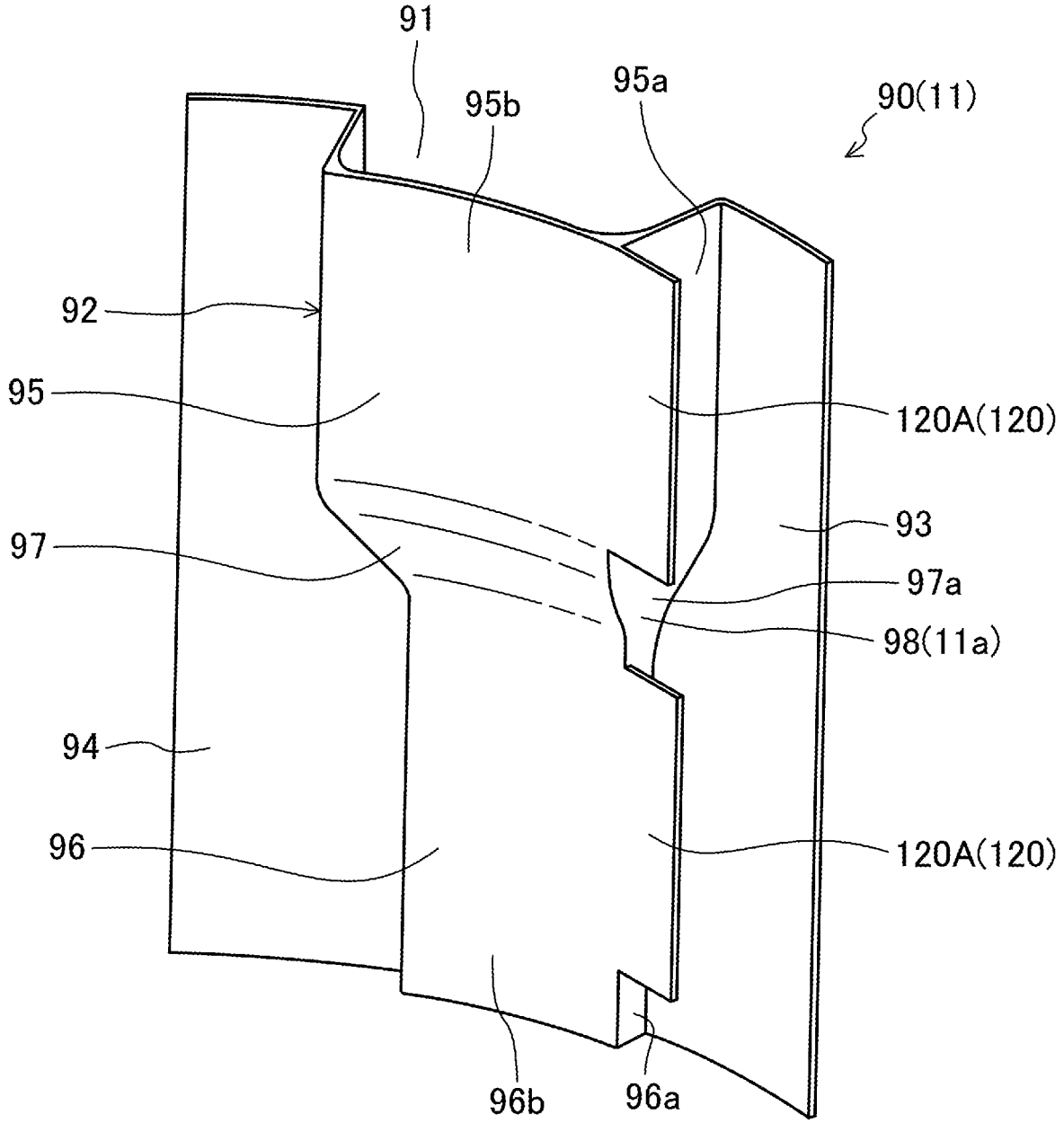
FIG. 13 is a perspective view illustrating an oil return guide of a first variation.

As illustrated in FIG. 13, in a compressor (10) of a first variation, another first blocking plate (120A) is provided also at a bent portion connecting the side surface (96*a*) and the outer surface (96*b*) of the bottom of the lower recess (96). In other words, the first blocking plate (120A) of this example includes two first blocking plates (120A) provided for upper and lower portions of the recessed portion (92). The lower first blocking plate (120A) faces the first curved plate portion (93) in the radial direction. The lower recess (96), the first curved plate portion (93), and the lower first blocking plate (120A) form a dead end that interrupts the flow of the gas refrigerant in the circumferential direction. The outer surface of the lower first blocking plate (120A) is flush with the outer surface (96*b*) of the bottom of the lower recess (96) in the circumferential direction.

According to the compressor (10) of this first variation, the lower first blocking plate (120A) blocks the oil (OL) deposited on the side surface (96*a*) of the lower recess (96) of the oil return guide (90) from flowing inward in the radial direction. It is thus possible to reduce the chances effectively in which the oil (OL) is scattered again from the surface of the lower recess (96) of the oil return guide (90) and mixed again in the gas refrigerant.

Second Variation

Figure 14:
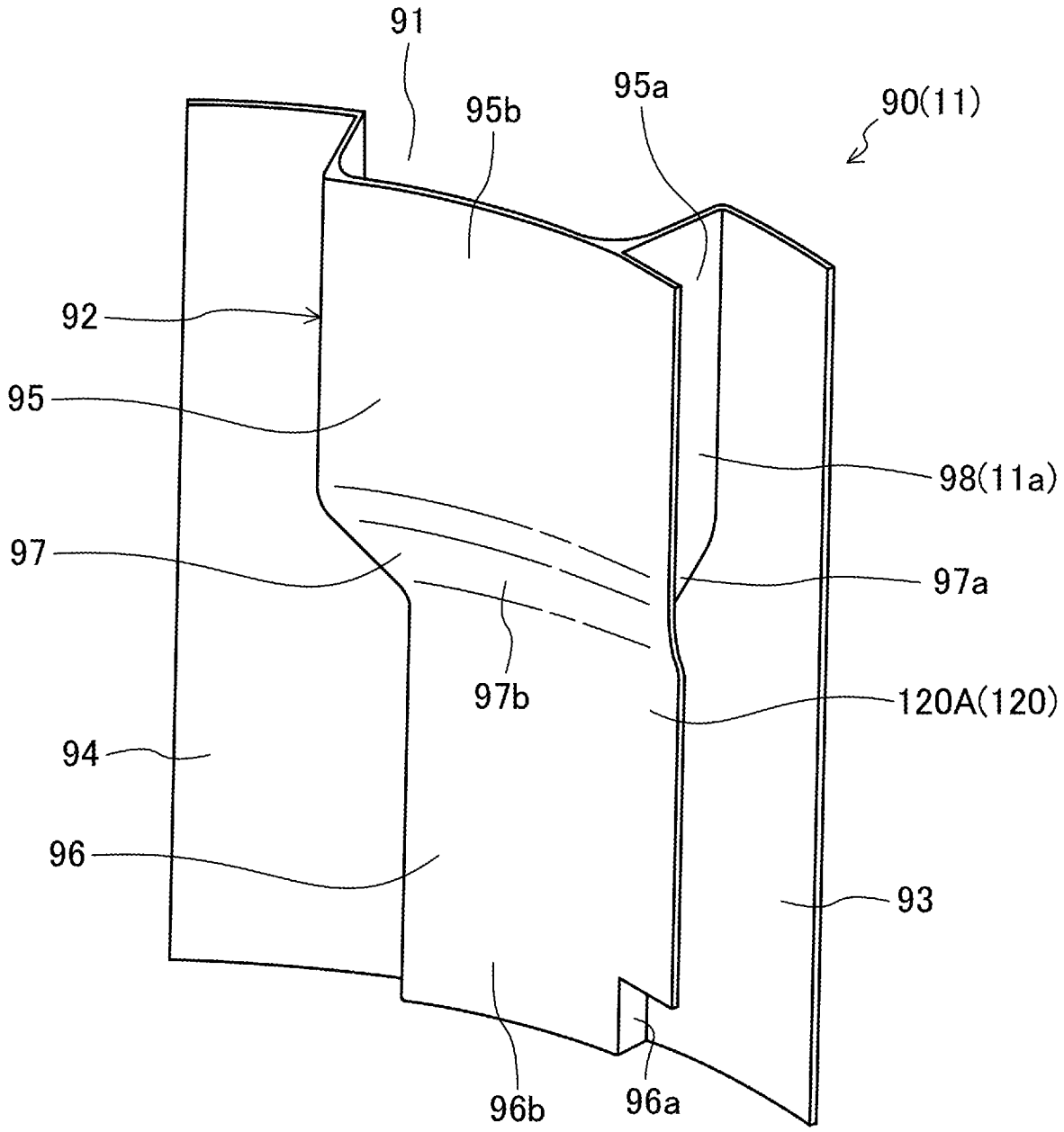
FIG. 14 is a perspective view illustrating an oil return guide of a second variation.

As illustrated in FIG. 14, in a compressor (10) of this second variation, the first blocking plate (120A) extends along the substantially entire axial length of the recessed portion (92). The first blocking plate (120A) of this example is continuous at bent portions connecting the side surfaces (95*a*, 96*a*, 97*a*) and the outer surfaces (95*b*, 96*b*, 97*b*) of the bottoms of the upper recess (95), the lower recess (96), and the inclined recess (97). The first blocking plate (120A)

faces the first curved plate portion (93) in the radial direction. The recessed portion (92), the first curved plate portion (93), and the first blocking plate (120A) form a dead end that interrupts the flow of the gas refrigerant in the circumferential direction. The outer surface of the first blocking plate (120A) is flush with the outer surface of the bottom of the recessed portion (92) in the circumferential direction.

According to the compressor (10) of this second variation, the first blocking plate (120A) blocks the oil (OL) deposited on the side surfaces (95*a*, 96*a*, 97*a*) of the upper recess (95), the lower recess (96), and the inclined recess (97) of the oil return guide (90) from flowing inward in the radial direction. It is thus possible to reduce the chances effectively in which the oil (OL) is scattered again from the surface of the recessed portion (92) of the oil return guide (90) and mixed again in the gas refrigerant.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

For example, in the foregoing embodiment, the gas guide (100) may include two second blocking plates (120B) provided for upper and lower portions of the recessed portion (102), similarly to the first blocking plates (120A) of the oil return guide (90) according to the first variation. The second blocking plate (120B) of the gas guide (100) may extend along the substantially entire axial length of the recessed portion (92), similarly to the first blocking plate (120A) of the oil return guide (90) according to the second variation.

In the above embodiment, the first blocking plate (120A) of the oil return guide (90) may be inclined so that the closer to the distal end, the closer to the inner peripheral surface of the casing (12), with respect to the posture directly facing the first curved plate portion (93). The first blocking plate (120A) of the oil return guide (90) may be inclined so that the closer to the distal end, the farther from the inner peripheral surface of the casing (12), with respect to the posture directly facing the first curved plate portion (93). The same statements apply to the second blocking plate (120B) of the gas guide (100).

In the above embodiment, the third blocking plate (120C) of the lower frame (30) may be inclined so that the closer to the distal end, the closer to the oil separation plate (45), with respect to the posture directly facing the oil separation plate (45). The third blocking plate (120C) of the lower frame (30) may be inclined so that the closer to the distal end, the farther from the oil separation plate (45), with respect to the posture directly facing the oil separation plate (45).

In the above embodiment, the fourth blocking plate (120D) of the housing (20) may be inclined so that the closer to the distal end, the closer to the lower surface (22*a*) of the first bearing tube portion (22), with respect to the posture directly facing the lower surface (22*a*) of the first bearing tube portion (22). The fourth blocking plate (120D) of the housing (20) may be inclined so that the closer to the distal end, the farther from the lower surface (22*a*) of the first bearing tube portion (22), with respect to the posture directly facing the lower surface (22*a*) of the first bearing tube portion (22).

In the above embodiment, the first blocking plate (120A) may be configured as a separate member from the oil return guide (90). In this case, the first blocking plate (120A) is joined to the oil return guide (90) by welding, for example, and integrated with the oil return guide (90). The second blocking plate (120B) may be configured as a separate member from the gas guide (100). In this case, the second blocking plate (120B) may be joined to the gas guide (100) by welding, for example, and integrated with the gas guide (100). The third blocking plate (120C) may be integrated with the lower frame (30). The fourth blocking plate (120D) may be integrated with the housing (20).

In the above embodiment, the configuration for preventing the oil (OL) from being scattered again may be applied to any one of the oil return guide (90), the gas guide (100), the housing (20), or the lower frame (30), or only two or three of them. For example, the block(s) (120) may be provided for one of the oil return guide (90) or the gas guide (100) or only both of them. The blocking part (120) may be provided only for the housing (20) or for the lower frame (30).

In the above embodiment, the first to fourth blocking plates (120A, 120B, 120C, 120D) have been described as examples of the blocking part (120). However, the blocking part (120) is not limited to the plate-like objects, and various types can be used as the blocking part (120) as long as it can block the flow of the oil (OL) deposited on the facing surface (11*a*), of the associated component (11), which faces against the gas flow. For example, the blocking part (120) may be an object in the shape of a block, or a groove that traps the oil (OL).

The ordinal numbers such as "first," "second," "third," . . . , described above are used to distinguish the terms to which these expressions are given, and do not limit the number and order of the terms.

As described above, the present disclosure is useful for a compressor and a refrigeration apparatus.

The invention claimed is:

1. A compressor comprising:

a casing;

an electric motor housed in the casing; and a compression mechanism driven by the electric motor, the compression mechanism being configured to discharge a gas compressed to an internal space of the casing, the gas discharged from the compression mechanism forming a gas flow that flows in a predetermined circumferential direction in the internal space of the casing, the compressor having one of a configuration (1) or a configuration (2), or both of the configurations (1) and (2);

(1) an oil return guide configured to guide oil used in the compression mechanism to an oil reservoir formed in the casing, or a gas guide configured to guide the gas discharged from the compression mechanism, being arranged in the internal space of the casing, the oil return guide or the gas guide including a first side surface facing in a direction against the predetermined circumferential direction in the internal space of the casing, an outer surface adjacent to the first side surface and facing a center of the casing, and a bent portion connecting the first side surface and the outer surface and protruding into the internal space, and the bent portion being provided with a first blocking part configured to block a flow of oil deposited on the first side surface due to a collision of the gas flow, the first blocking part protruding in the direction toward which the first side surface faces; and (2) the compressor further comprising a bearing configured to support a drive shaft of the electric motor, a frame being disposed in the internal space of the casing, the frame being configured to fix the bearing to the casing, the frame including a second side surface facing the center of the casing, an upper surface adjacent to the second side surface and facing upward of the casing, and a corner portion formed by the second side surface and the upper surface and protruding into the internal space, and the corner portion being provided with a second blocking part configured to block a flow of oil deposited on the second side surface due to a collision of the gas flow, the second blocking part protruding in a direction toward which the second side surface faces.

2. The compressor of claim 1, wherein the first blocking part is a plate shaped object that protrudes in the direction against the predetermined circumferential direction, and the second blocking part is a plate shaped object that protrudes toward the center of the casing.

3. The compressor of claim 2, wherein one or both of the first and second blocking parts is integrated with the oil return guide, the gas guide, or the frame.

4. A refrigeration apparatus including the compressor of claim 3.

5. The compressor of claim 2, further comprising:

a discharge pipe through which the gas is discharged from a high-pressure space within the casing in which the gas flow occurs, to outside the casing, the discharge pipe passing through the casing in a radial direction, and the discharge pipe protruding inward of the high-pressure space from an inner peripheral surface of the casing, and one or both of the first and second blocking parts being arranged so as to be closer to outside in the radial direction of the casing than an inflow port of the discharge pipe through which the gas flows in.

6. A refrigeration apparatus including the compressor of claim 5.

7. The compressor of claim 2, wherein one or both of the first and second blocking parts is configured as a separate member from the oil return guide or the gas guide.

8. A refrigeration apparatus including the compressor of claim 7.

9. A refrigeration apparatus including the compressor of claim 2.

10. The compressor of claim 1, wherein one or both of the first and second blocking parts is configured as a separate member from the oil return guide, the gas guide, or the frame.

11. The compressor of claim 10, further comprising:

a discharge pipe through which the gas is discharged from a high-pressure space within the casing in which the gas flow occurs, to outside the casing, the discharge pipe passing through the casing in a radial direction, and protruding inward of the high-pressure space from an inner peripheral surface of the casing, and one or both of the first and second blocking parts being arranged so as to be closer to outside in the radial direction of the casing than an inflow port of the discharge pipe through which the gas flows in.

12. A refrigeration apparatus including the compressor of claim 11.

13. A refrigeration apparatus including the compressor of claim 10.

14. The compressor of claim 1, wherein one or both of the first and second blocking parts is integrated with the oil return guide, the gas guide, or the frame.

15. The compressor of claim 14, further comprising:

a discharge pipe through which the gas is discharged from a high-pressure space within the casing in which the gas flow occurs, to outside the casing, the discharge pipe passing through the casing in a radial direction, and protruding inward of the high-pressure space from an inner peripheral surface of the casing, and one or both of the first and second blocking parts being arranged so as to be closer to outside in the radial direction of the casing than an inflow port of the discharge pipe through which the gas flows in.

16. A refrigeration apparatus including the compressor of claim 15.

17. A refrigeration apparatus including the compressor of claim 14.

18. The compressor of claim 1, further comprising:

a discharge pipe through which the gas is discharged from a high-pressure space within the casing in which the gas flow occurs, to outside the casing, the discharge pipe passing through the casing in a radial direction, and the discharge pipe protruding inward of the high-pressure space from an inner peripheral surface of the casing, and one or both of the first and second blocking parts being arranged so as to be closer to outside in the radial direction of the casing than an inflow port of the discharge pipe through which the gas flows in.

19. A refrigeration apparatus including the compressor of claim 18.

20. A refrigeration apparatus including the compressor of claim 1.

* * * * *